US008764510B1

(12) United States Patent
Wong

(10) Patent No.: US 8,764,510 B1
(45) Date of Patent: Jul. 1, 2014

(54) FIGHTING TOY

(71) Applicant: Silverlit Limited, Causeway Bay (HK)

(72) Inventor: Kwok Leung Wong, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 0 days.

(21) Appl. No.: 13/908,556

(22) Filed: Jun. 3, 2013

(51) Int. Cl.

| | |
|---|---|
| ***A63H 13/06*** | (2006.01) |
| ***A63H 29/22*** | (2006.01) |
| ***A63B 67/00*** | (2006.01) |
| ***A63H 13/00*** | (2006.01) |

(52) U.S. Cl.
CPC ..... *A63H 13/00* (2013.01)
USPC ..... 446/335; 446/484; 273/440.1

(58) Field of Classification Search
USPC ..... 446/268, 330, 331, 333–336, 376, 484; 273/440.1
See application file for complete search history.

(56) References Cited

U.S. PATENT DOCUMENTS

| | | | | |
|---|---|---|---|---|
| 1,799,735 | A * | 4/1931 | Crowell | 446/334 |
| 4,031,657 | A * | 6/1977 | Crosman et al. | 446/333 |
| 4,091,563 | A * | 5/1978 | Noble et al. | 273/440.1 |
| 4,995,610 | A * | 2/1991 | Paoletti | 463/8 |
| 5,290,185 | A * | 3/1994 | Murakami | 446/334 |
| 5,458,523 | A * | 10/1995 | Aoki et al. | 446/246 |
| 5,732,953 | A * | 3/1998 | Tamura | 273/440.1 |
| 5,766,077 | A * | 6/1998 | Hongo | 463/30 |
| 5,989,094 | A * | 11/1999 | Tamura | 446/335 |
| 6,315,630 | B1 * | 11/2001 | Yamasaki | 446/275 |
| 6,500,043 | B1 * | 12/2002 | Fong | 446/330 |
| 6,579,143 | B1 * | 6/2003 | Rehkemper et al. | 446/330 |
| 8,137,151 | B2 * | 3/2012 | Kenney | 446/330 |
| 2002/0107060 | A1 * | 8/2002 | Ohnuma et al. | 463/7 |

OTHER PUBLICATIONS

"Wireless Motion-Activated Controller Gives You Direct Fighting Control! Mini Battling Robots", BattroBerg 20, Takara TOMY News Release, Tomy Company, Ltd., pp. 1-2. http://www.takaratomy.co.jp/english/product_release/pdf/p12060_en.pdf.

* cited by examiner

*Primary Examiner* — Gene Kim
*Assistant Examiner* — Alyssa Hylinski
(74) *Attorney, Agent, or Firm* — Greenberg Traurig, LLP

(57) ABSTRACT

A toy comprises two robots. There is a lever with a shaft connecting at least one robot to a handle. The robot is responsive to movement of the handle through a physical mechanical connection with the handle whereby movement of the handle moves the robot. The movement of the handle by a player controls at least one of swing or turn movement of the robot. A supply of electricity to the robot is provided so that a motor with each robot permits making robot motions in response to movement from the motor. The motor movement is responsive to a signal from the player. The robots are for interaction with each other. An effective engagement between the robots is at least one of recorded or indicated. There is a control base, and a fighting stage. There is a lever system with a shaft connecting each respective robot to the handle.

29 Claims, 34 Drawing Sheets

FIGHTING TOY

FIELD OF DISCLOSURE

This disclosure relates to a fighting toy. In particular, the toy is a game for play between different players.

BACKGROUND

Different toys and games of fun and skill and fighting toys are known. They have different characteristics and disadvantages in relation to their form and complexity.

There is a need for a fighting toy and game and method of playing such a fighting toy and game which overcomes the disadvantages of known fighting toys and games and is a better fighting toy and game than existing fighting toys and games and methods of playing these toys and games.

SUMMARY

Different fighting toys and games of fun and skill are desired for players of different ages, particularly games that employ joy stick controls and reactive toys.

The present disclosure includes a one-to one robot fighting game operable by a player.

DRAWINGS

In order to further explain the characteristics of the disclosure, the following embodiments of an improved toy and game according to the disclosure are given as an example only, without being limitative in any way, with reference to the accompanying drawings, in which.

Figure 4A:
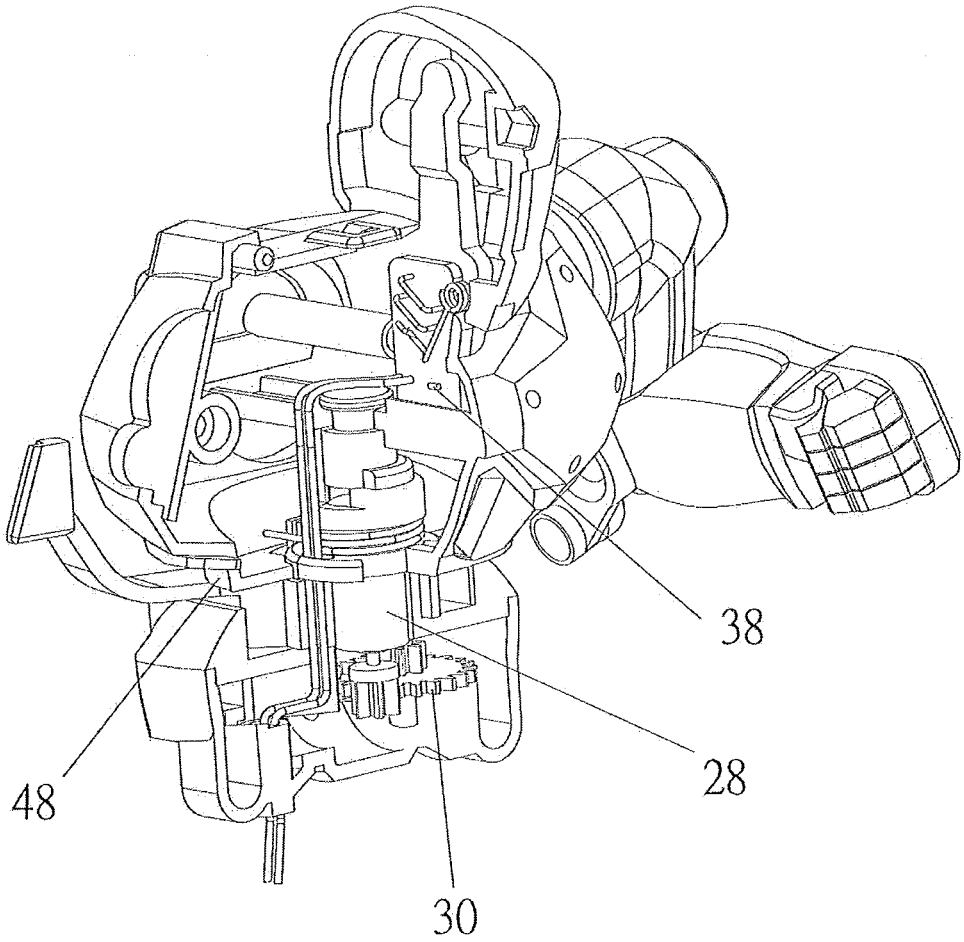

FIG. 4*a* is a detailed internal view representation of one of the robots showing the motor and gear system.

Figure 4B:
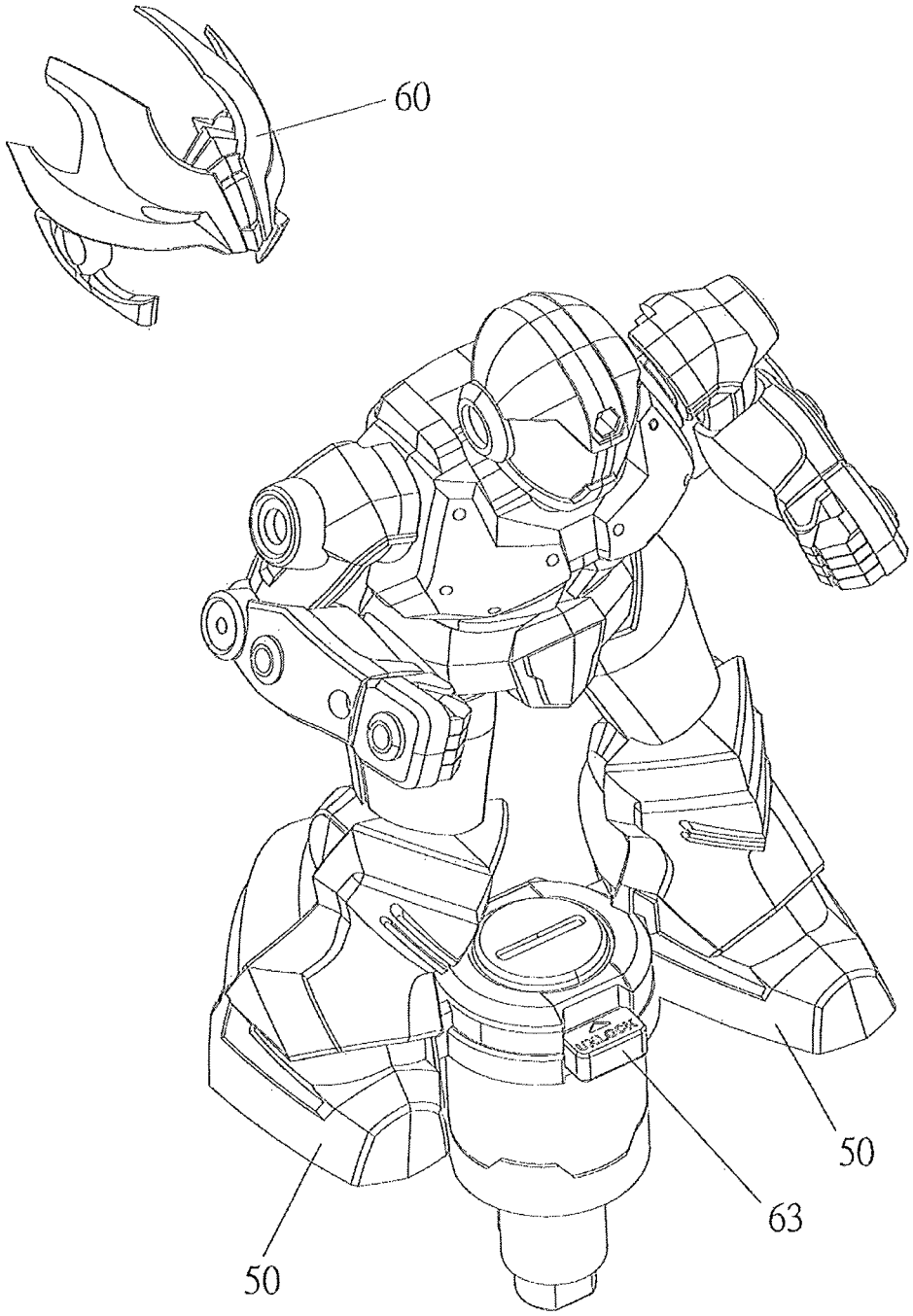

FIG. 4*b* is a representation of one of the robots.

Figure 5:
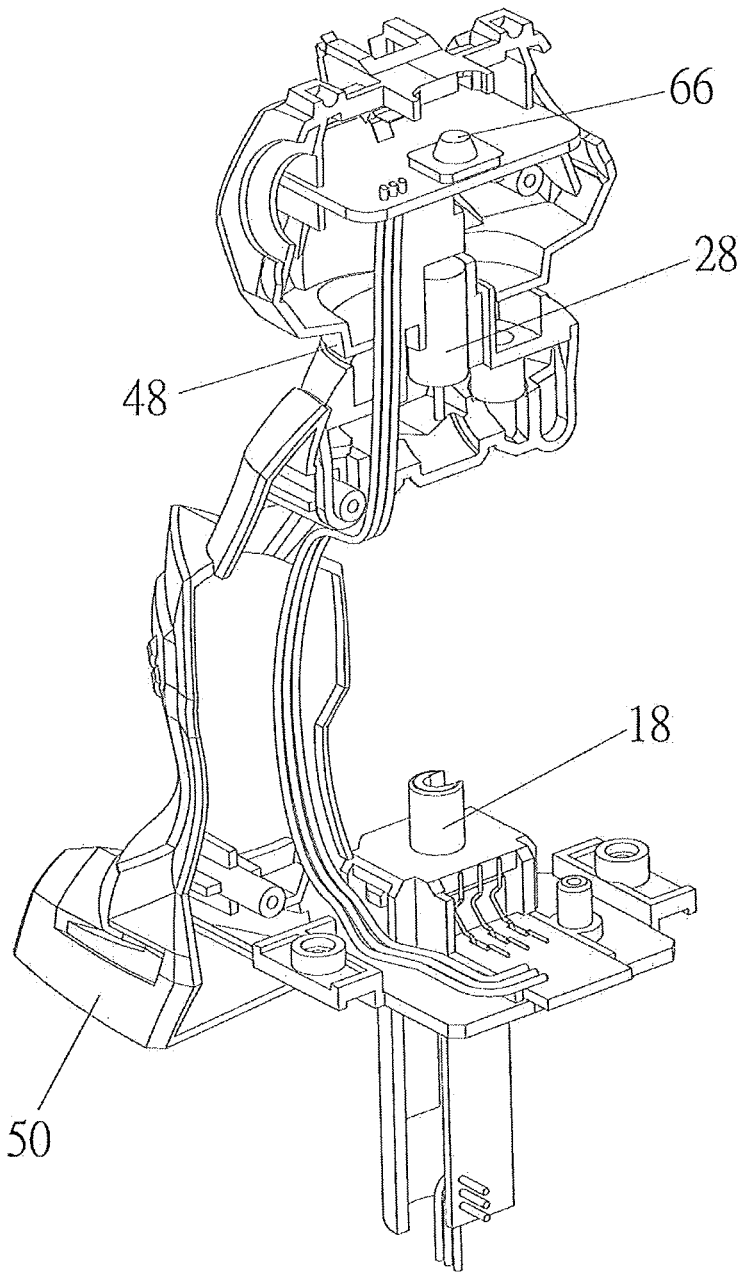

FIG. 5 is internal view representation of one of the handles showing the wiring system.

Figure 6A:
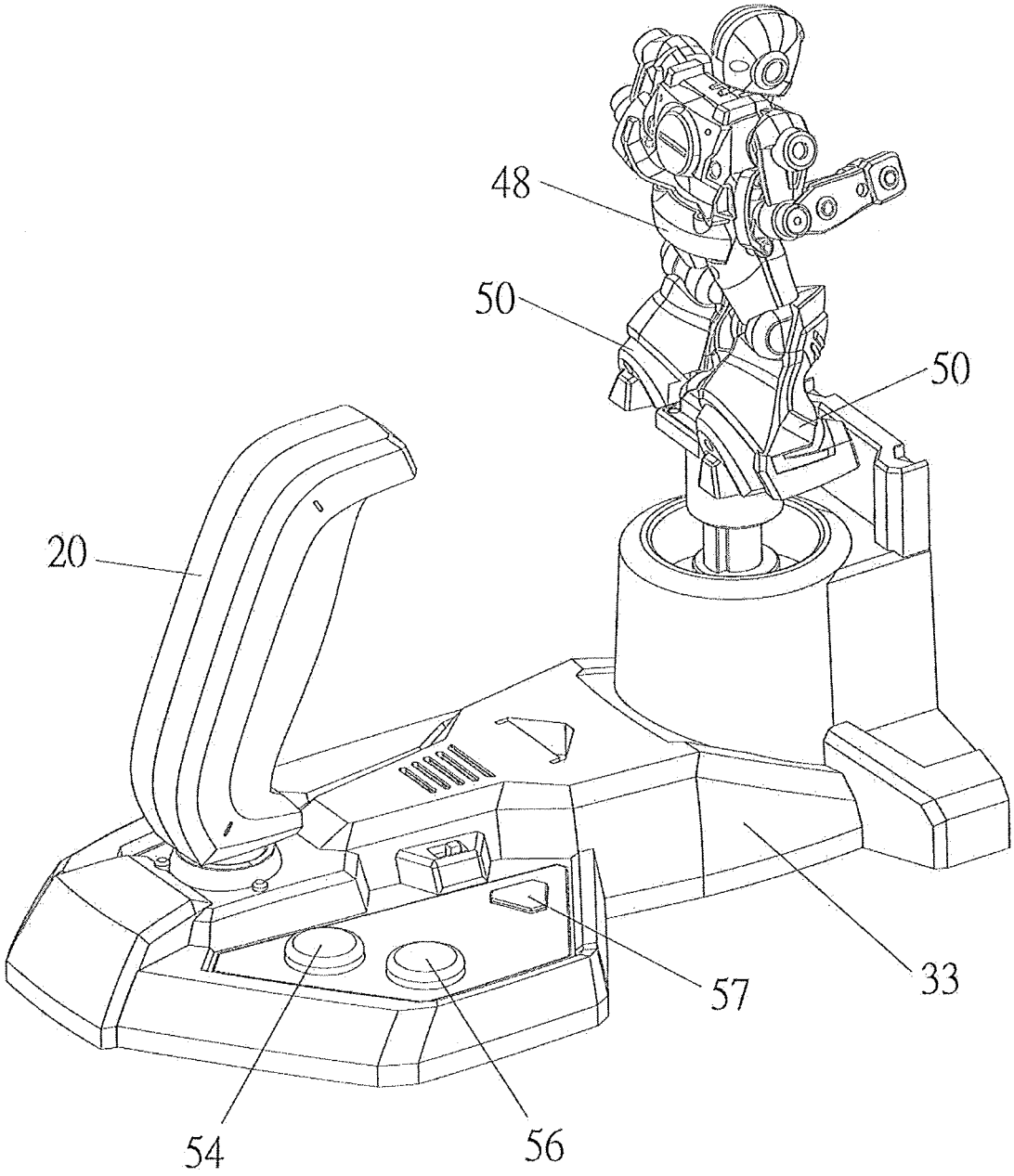

FIG. 6A is a representation of one of the robots, and associated handle and half of the control base for the mounting the robot in a first position.

Figure 6B:
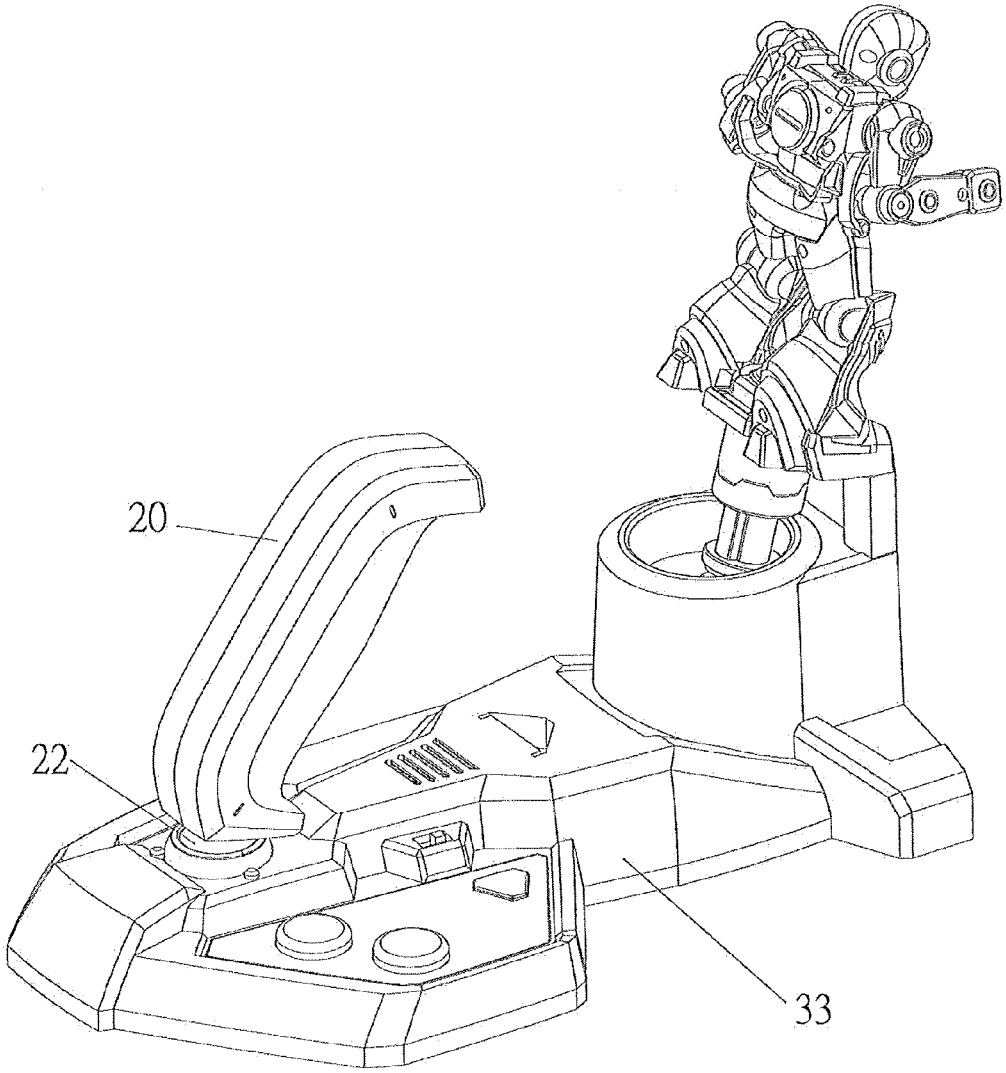

FIG. 6B is a representation of one of the robots, and associated handle and half of the control base for the mounting the robot in a second position.

Figure 6C:
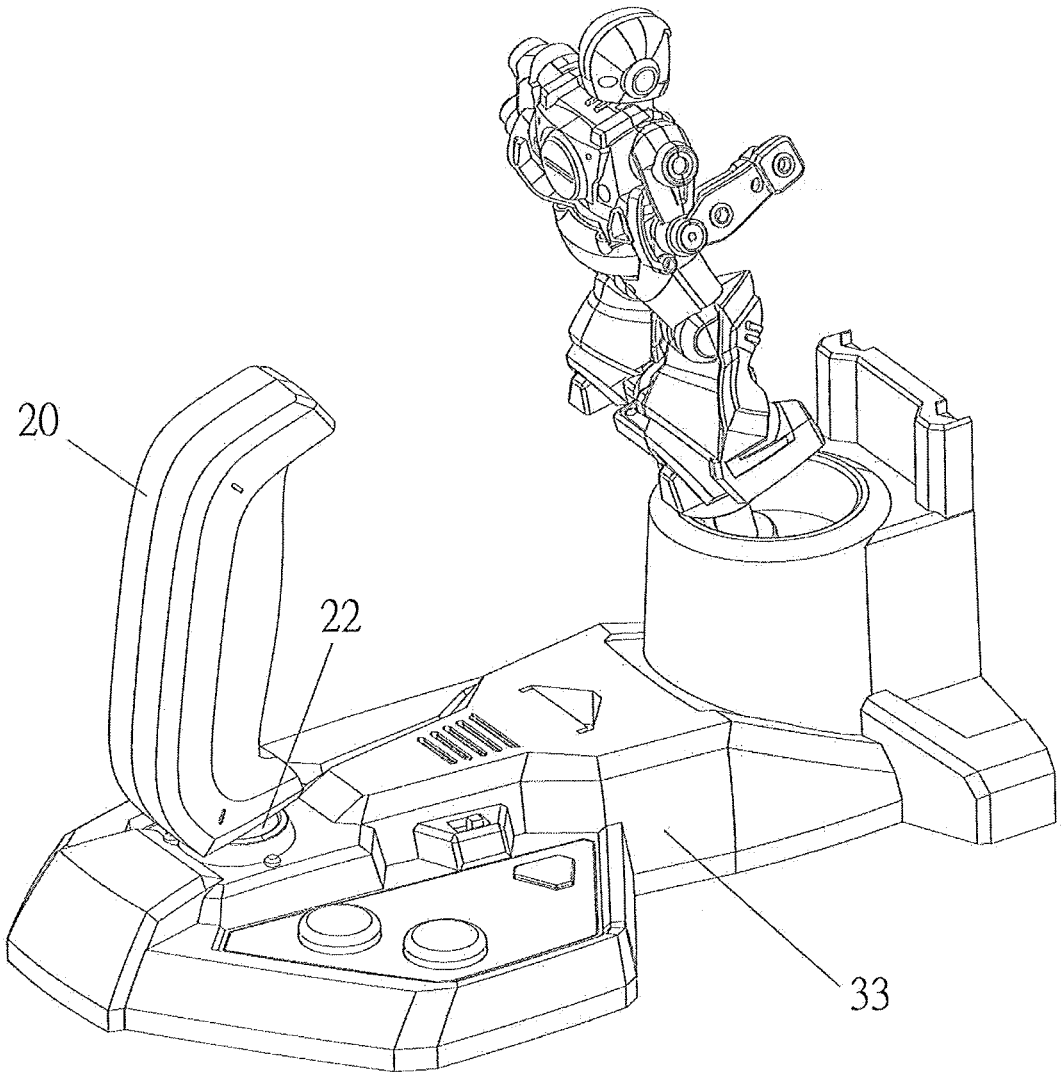

FIG. 6C is a representation of one of the robots, and associated handle and half of the control base for the mounting the robot in a third position.

Figure 6D:
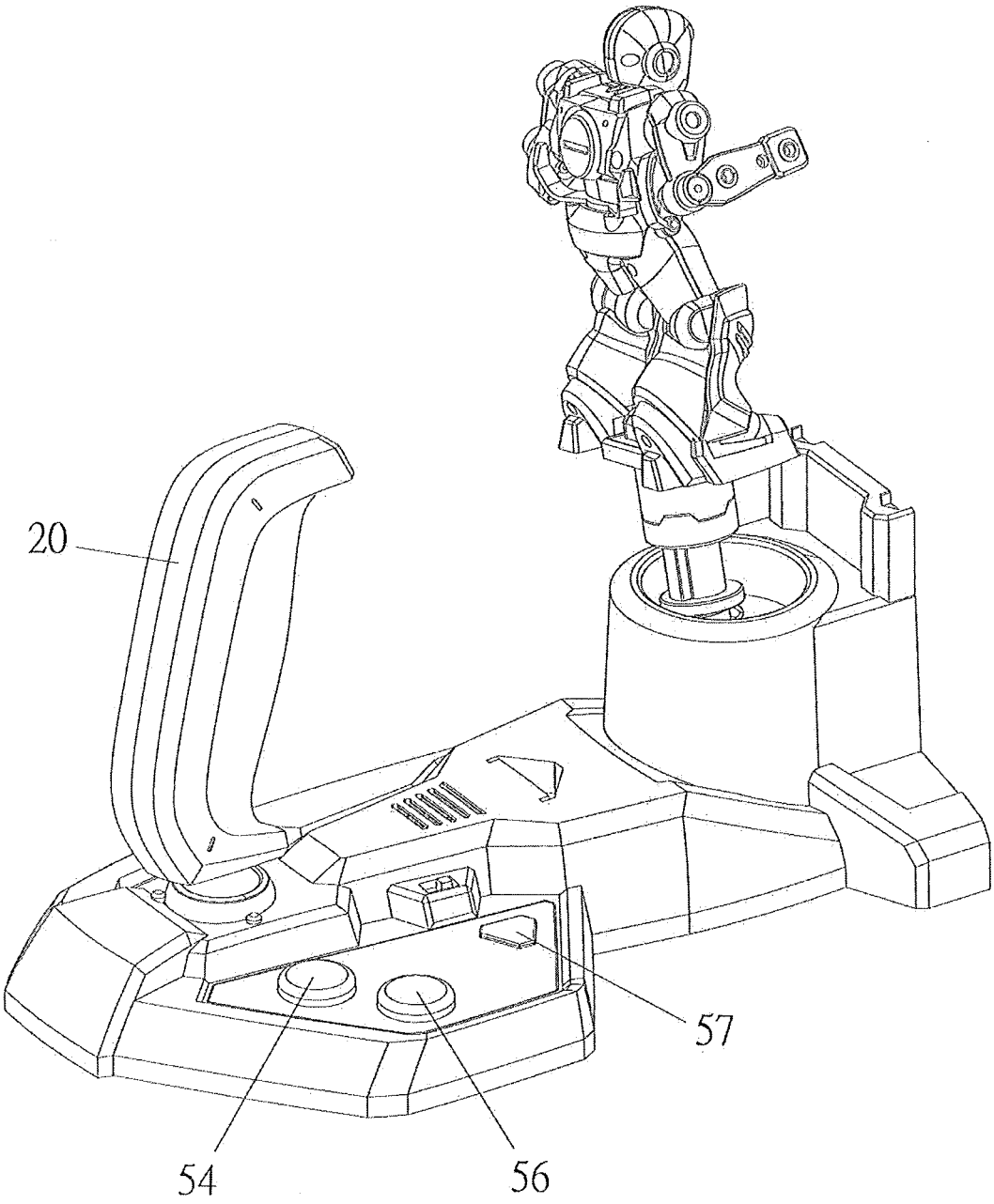

FIG. 6D is a representation of one of the robots, and associated handle and half of the control base for the mounting the robot in a fourth position.

Figure 6E:
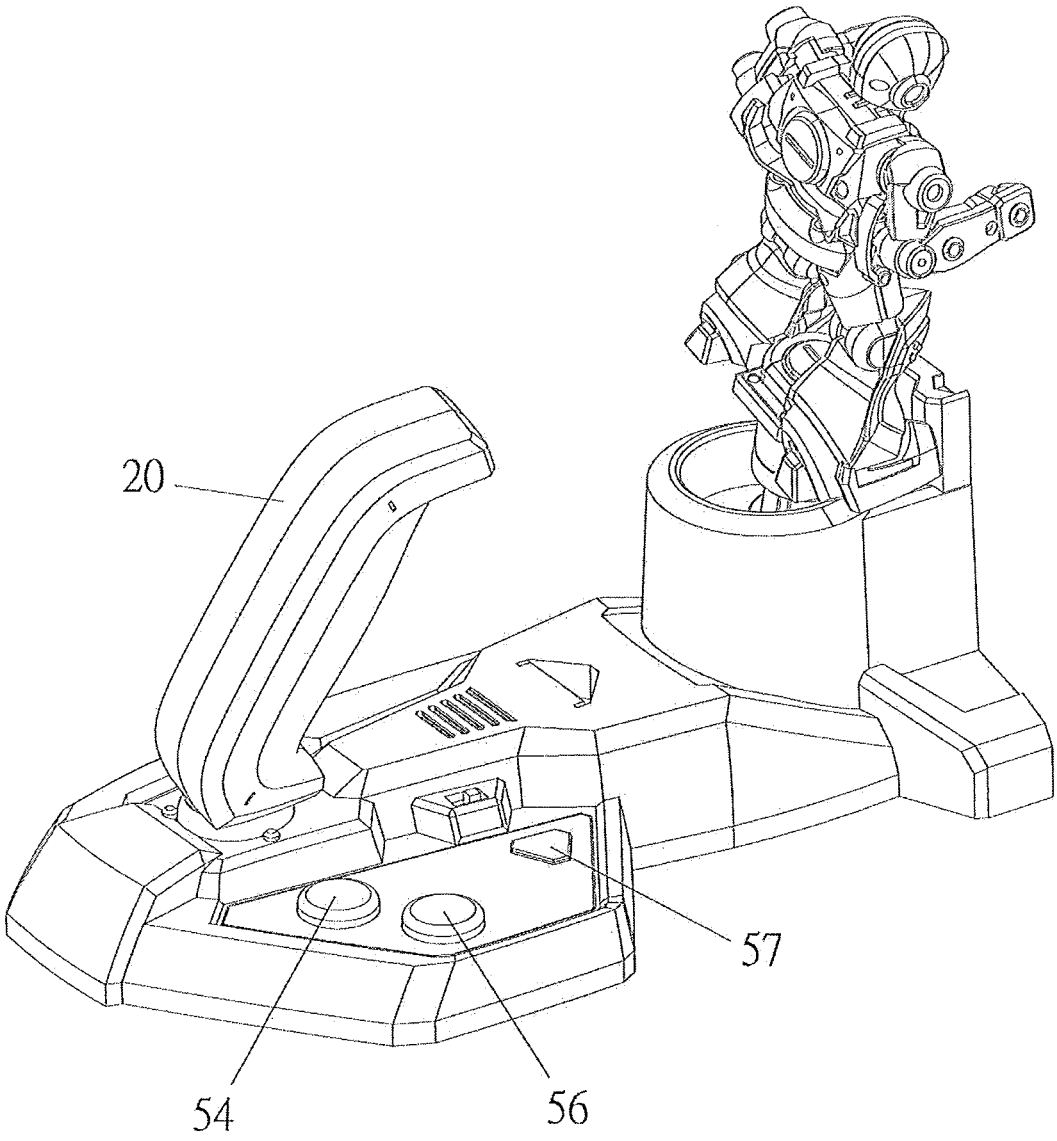

FIG. 6E is a representation of one of the robots, and associated handle and half of the control base for the mounting the robot in a fifth position.

Figure 6F:
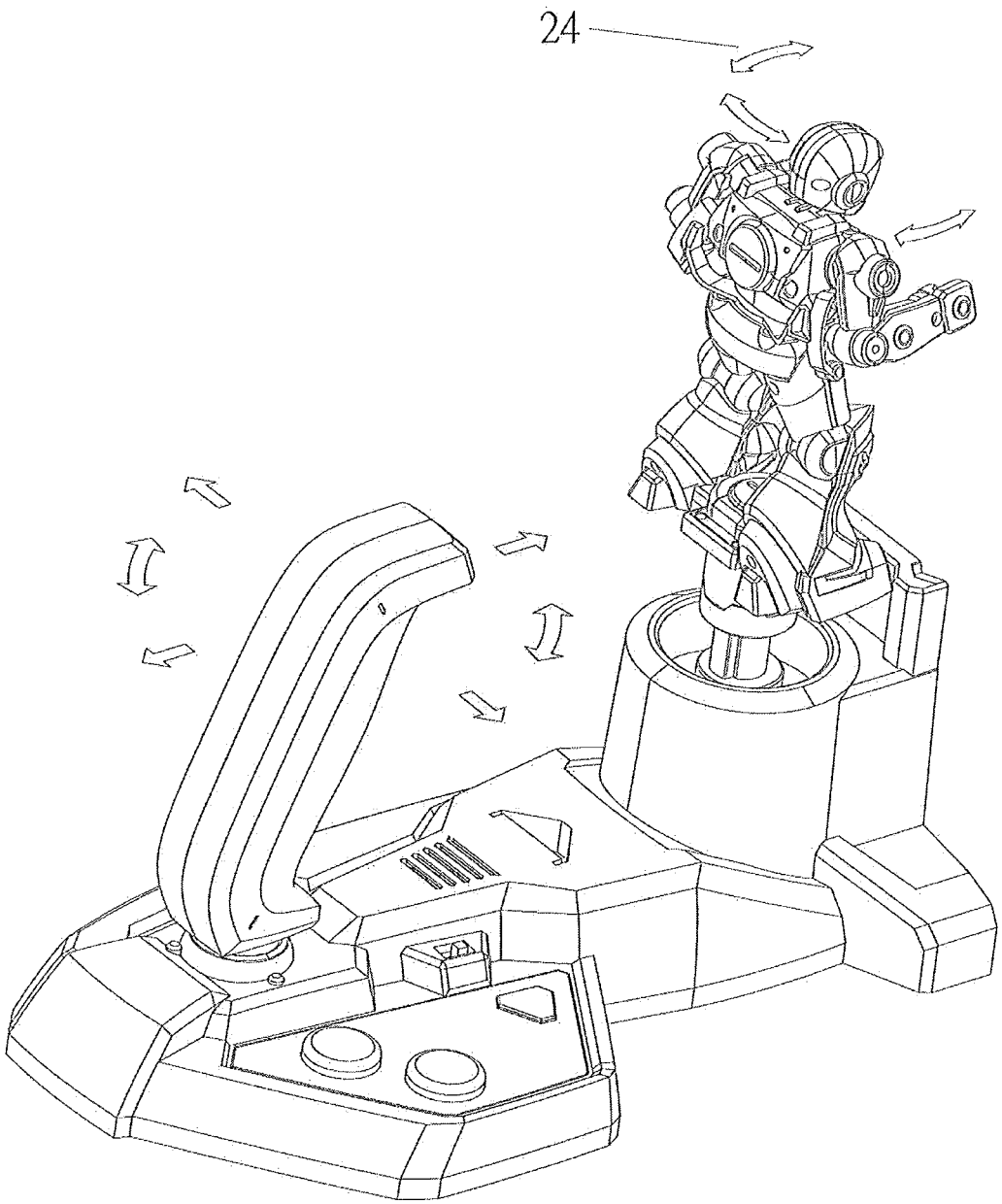

FIG. 6F is a representation of one of the robots, and associated handle and half of the control base for the mounting the robot in a sixth position.

Figure 7A:
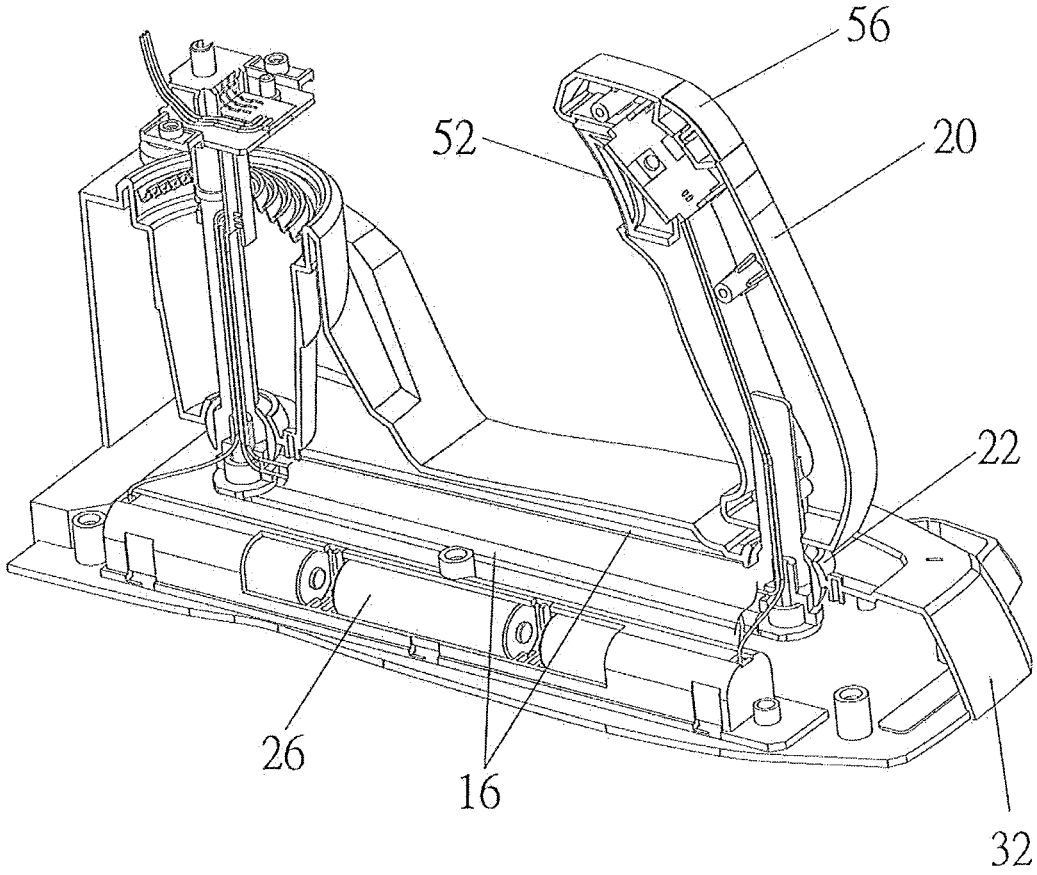

FIG. 7*a* is a representation, with parts broken away, of the handle and control base for the mounting the robot.

Figure 7B:
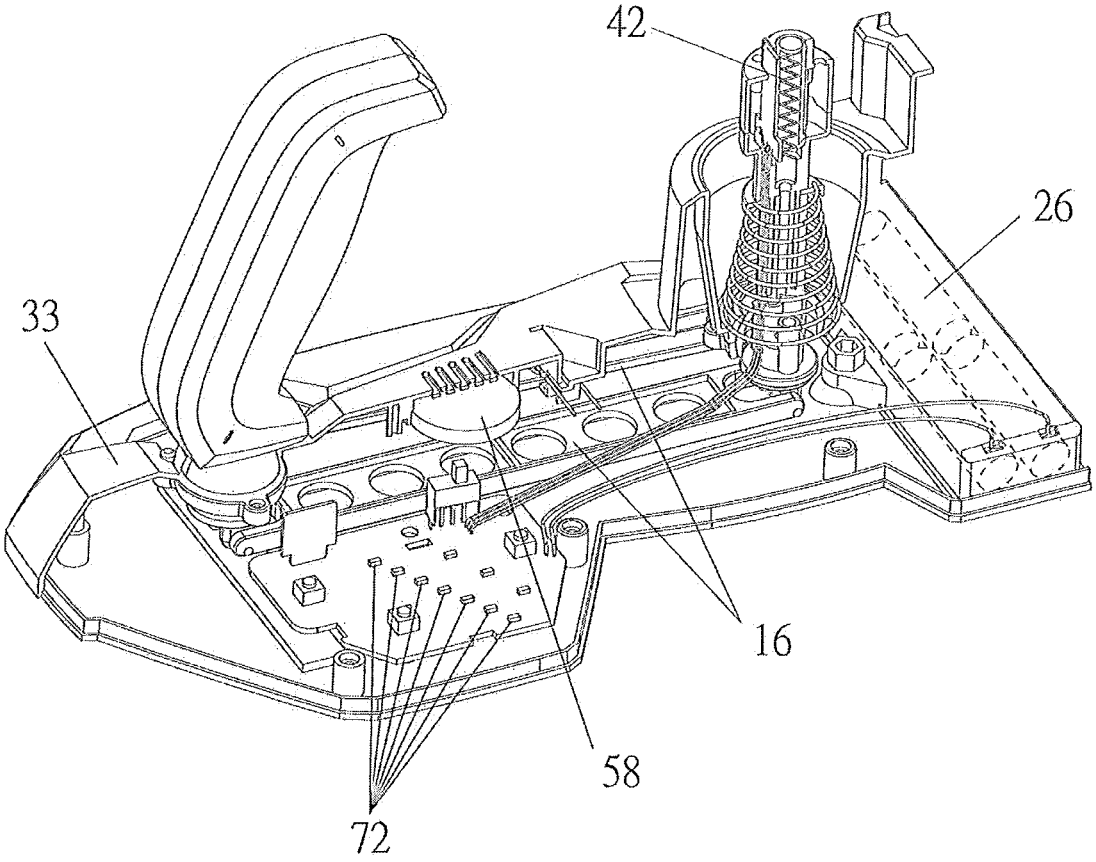

FIG. 7*b* is another representation, with parts broken away, of the handle and control base for the mounting the robot.

Figure 8A:
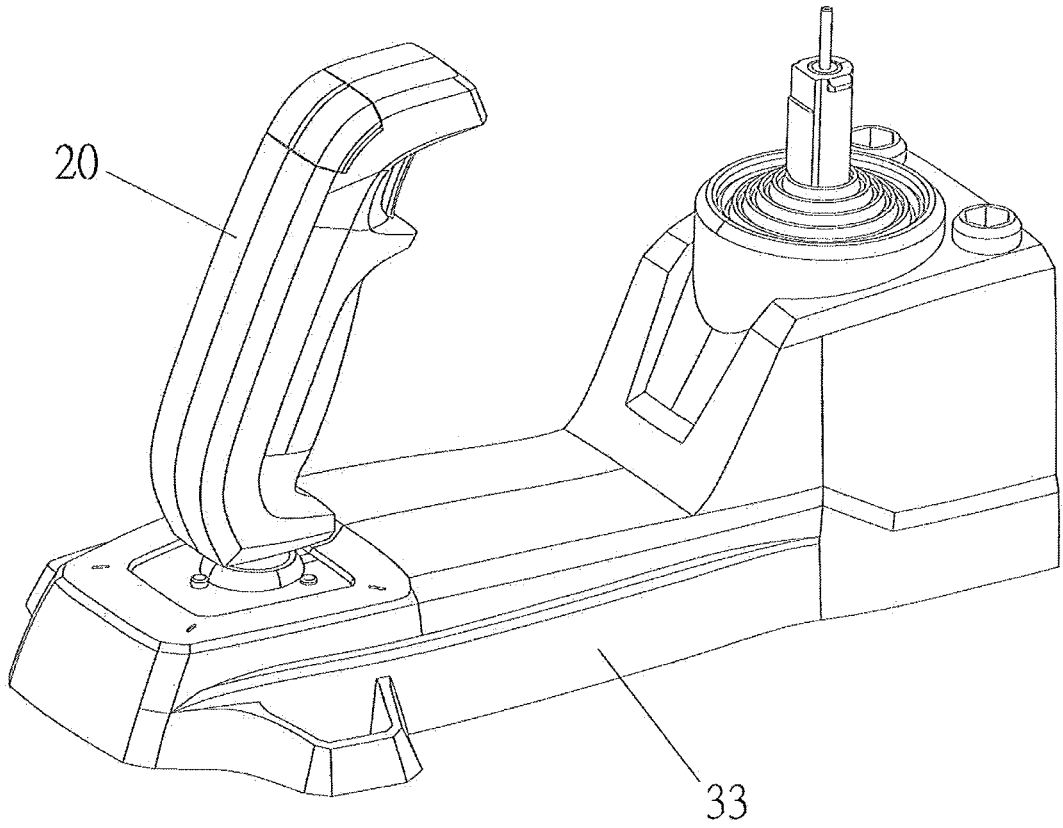

FIG. 8A is a representation of the handle and control base in a first position for the mounting the robot.

Figure 8B:
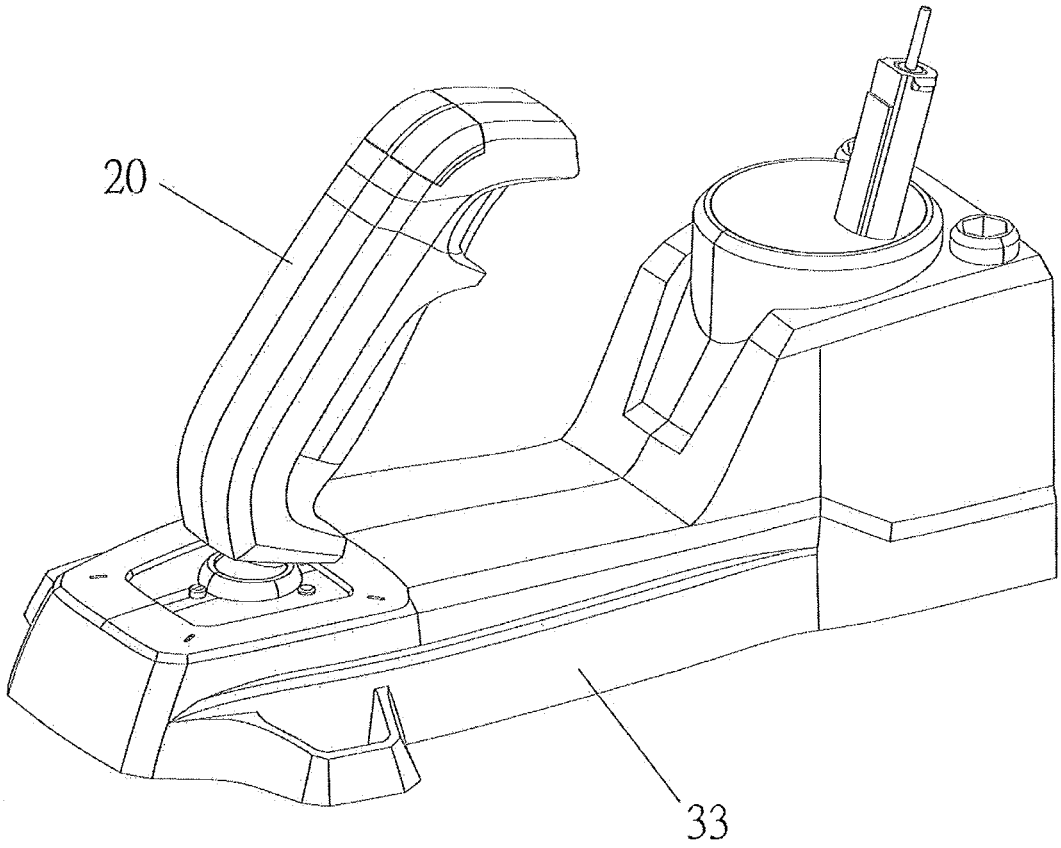

FIG. 8B is a representation of the handle and control base in a second position for the mounting the robot.

Figure 8C:
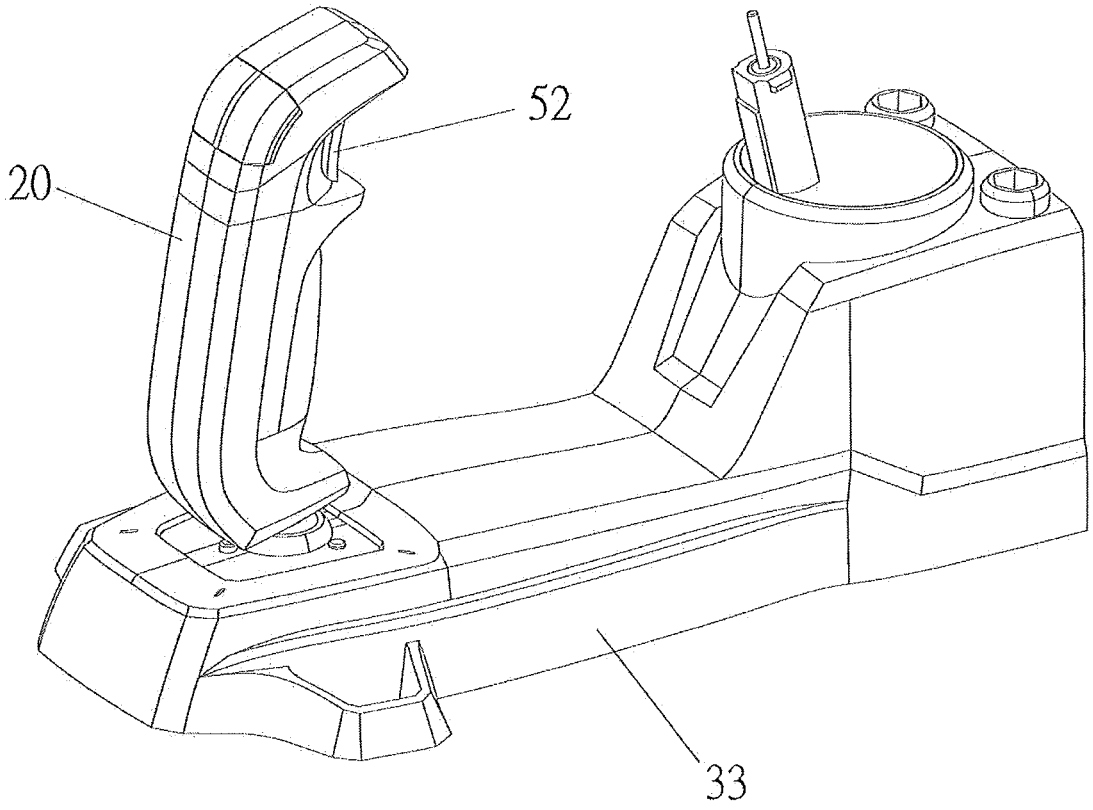

FIG. 8C is a representation of the handle and control base in a third position for the mounting the robot.

Figure 8D:
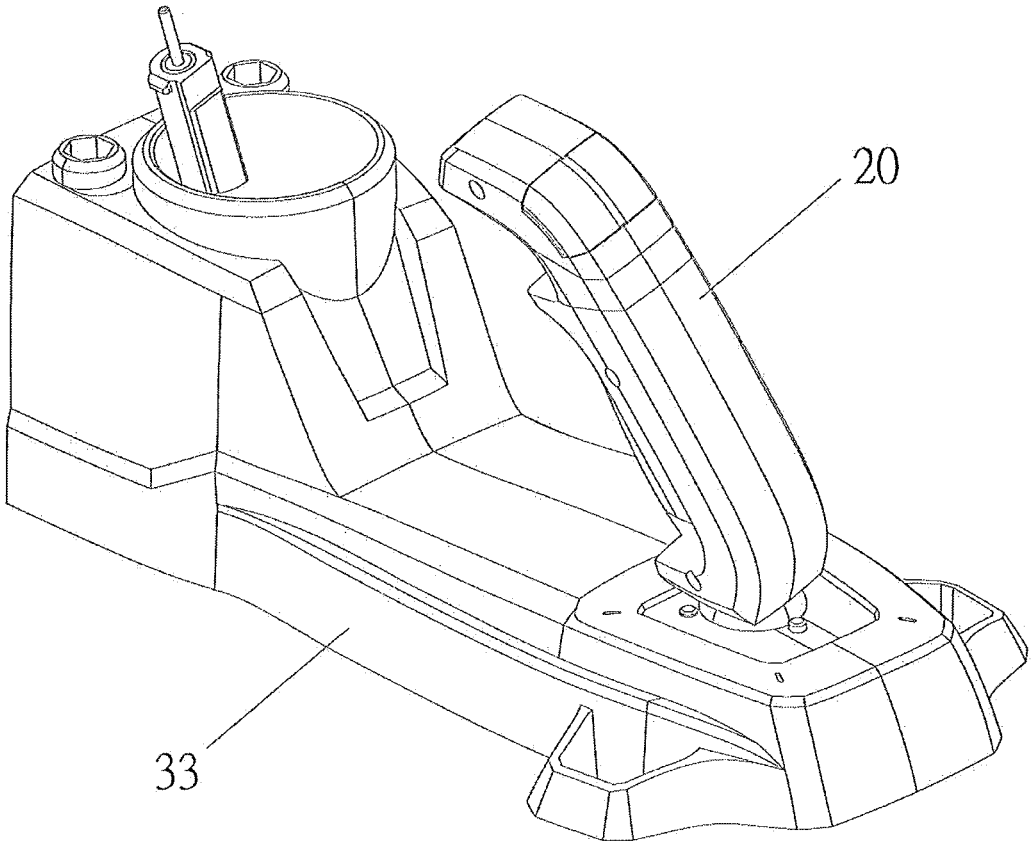

FIG. 8D is a representation of the handle and control base in a fourth position for the mounting the robot.

Figure 8E:
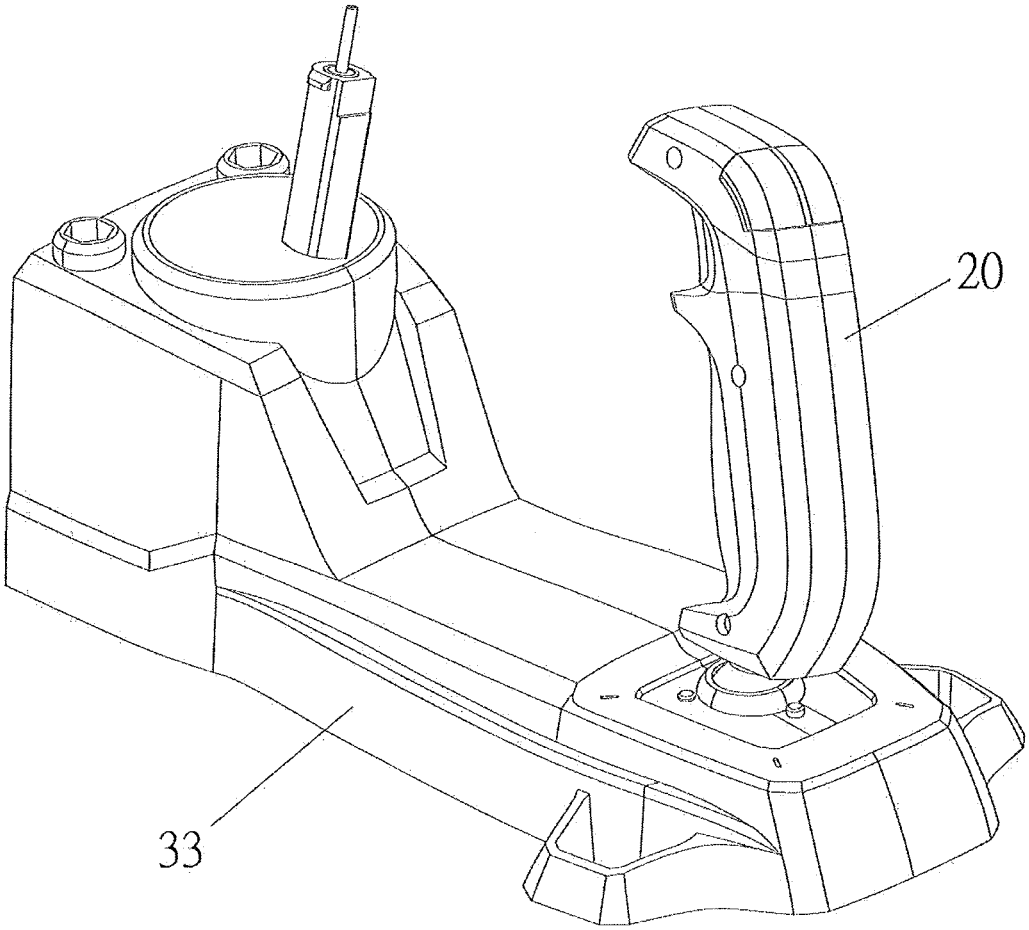

FIG. 8E is a representation of the handle and control base in a fifth position for the mounting the robot.

Figure 8F:
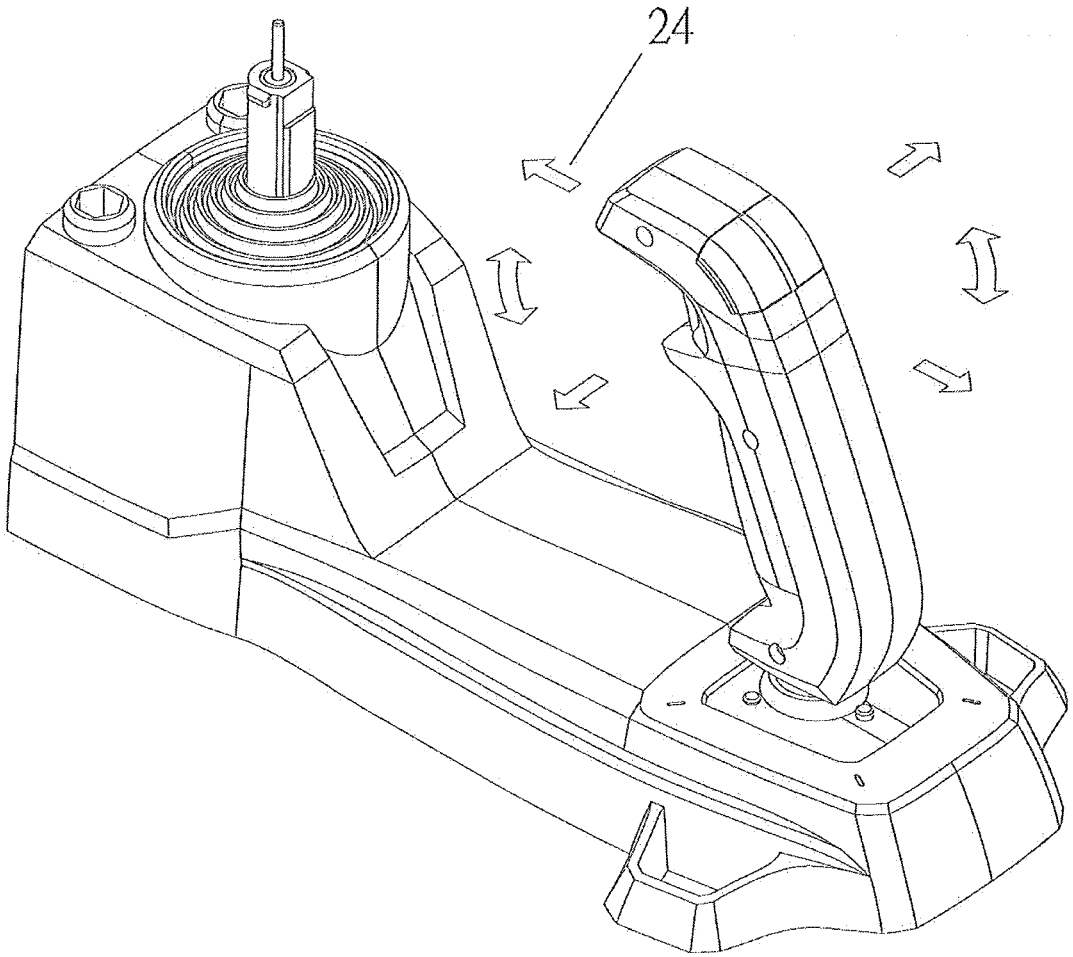

FIG. 8F is a representation of the handle and control base in a sixth position for the mounting the robot.

Figure 9:
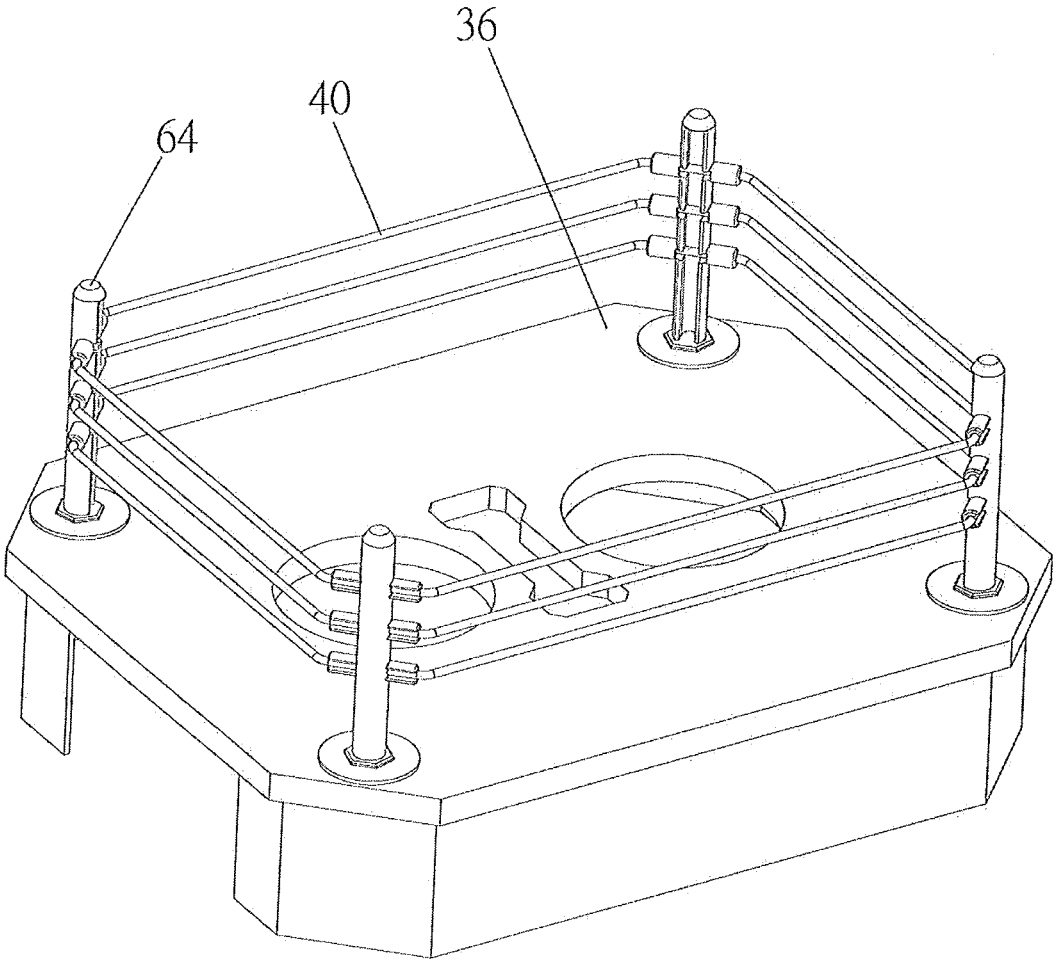

FIG. 9 is a detailed representation of the fighting stage.

Figure 10A:
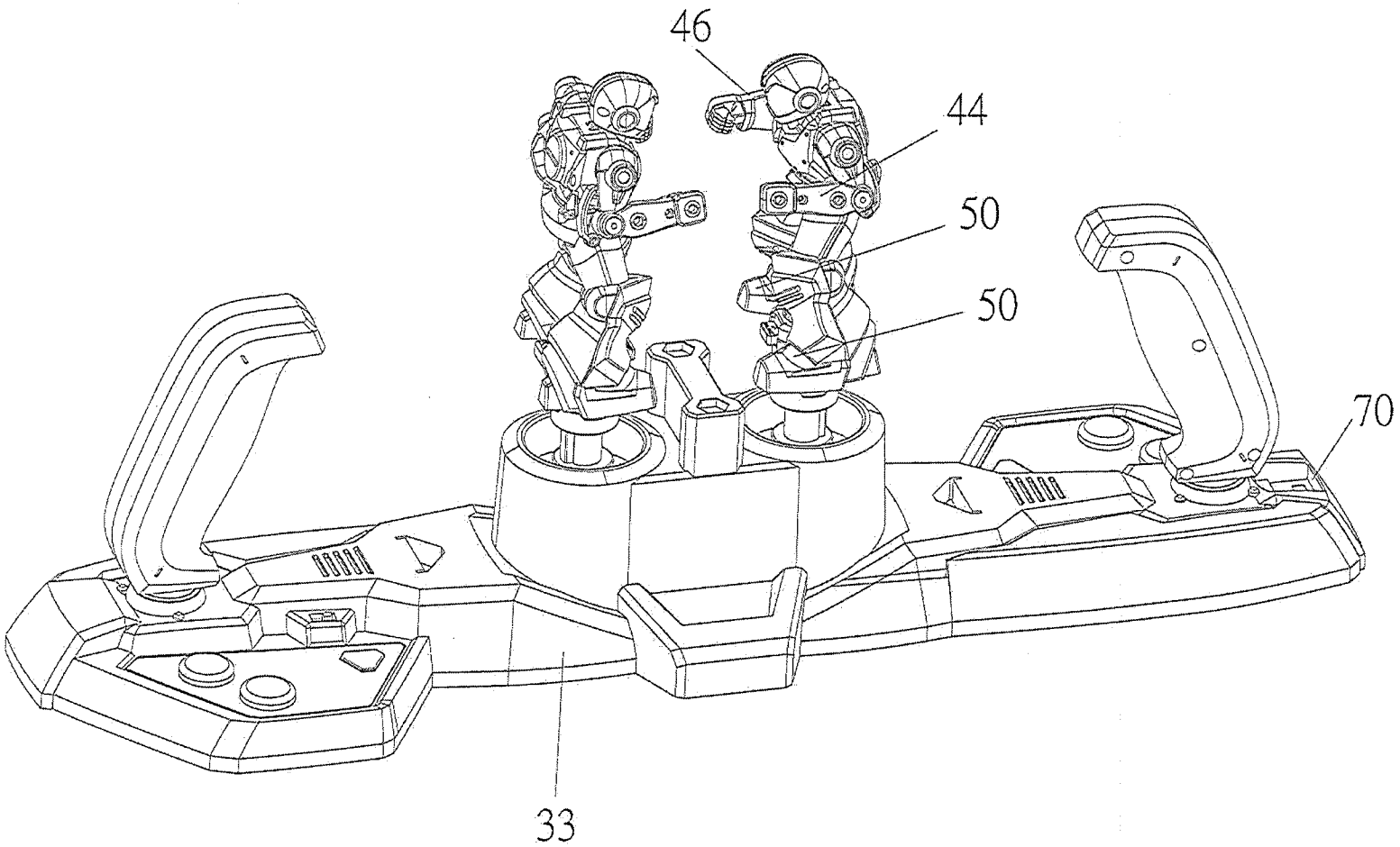

FIG. 10A is a representation of one of the robots, and associated handle and control base for the mounting the robot in a seventh position.

Figure 10B:
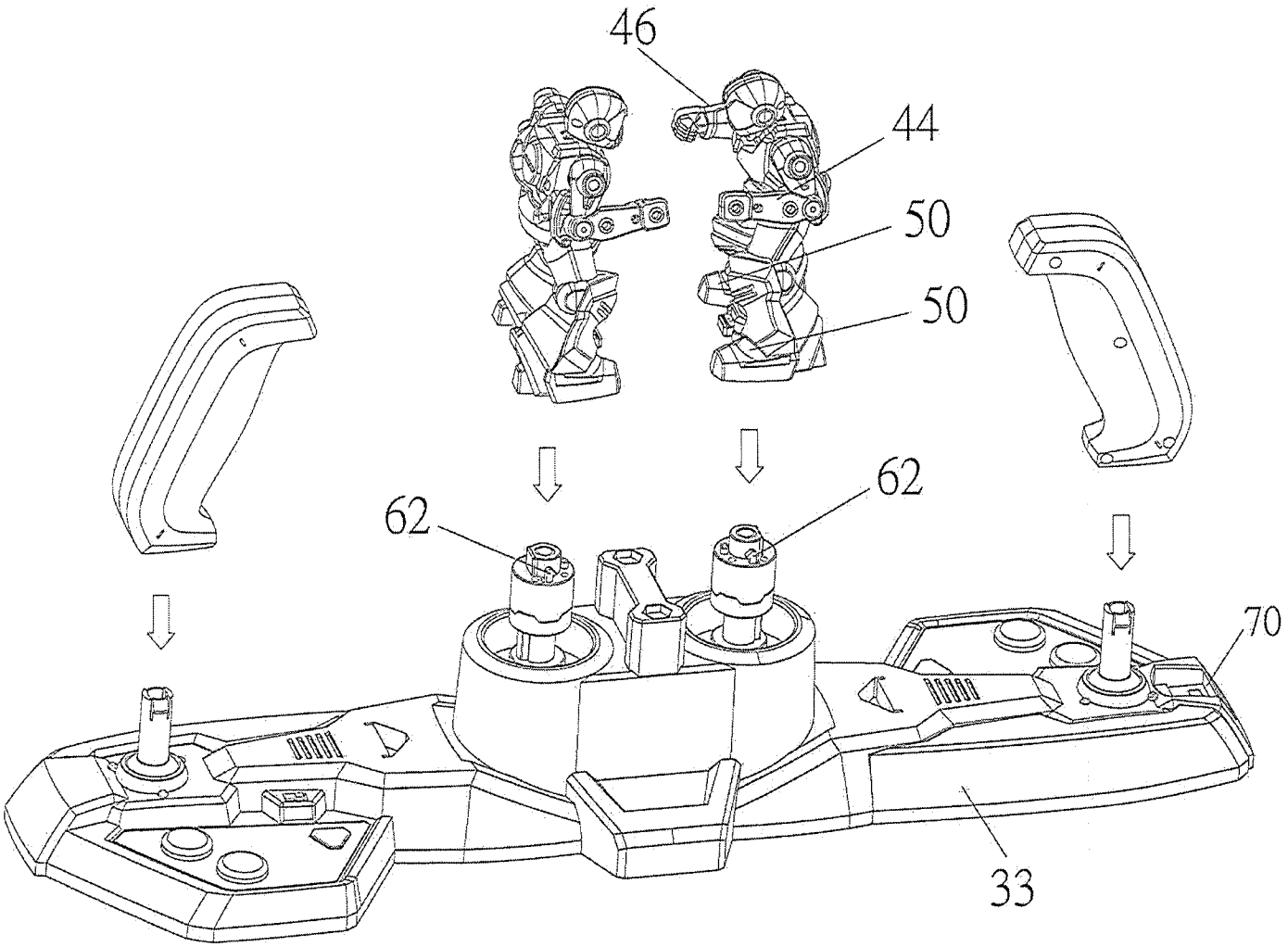

FIG. 10B is a representation of one of the robots, and associated handle and control base for the mounting the robot in a position with the robot separated from the control base and indicated to be inserted on the shaft passing outwards from the control base.

Figure 10C:
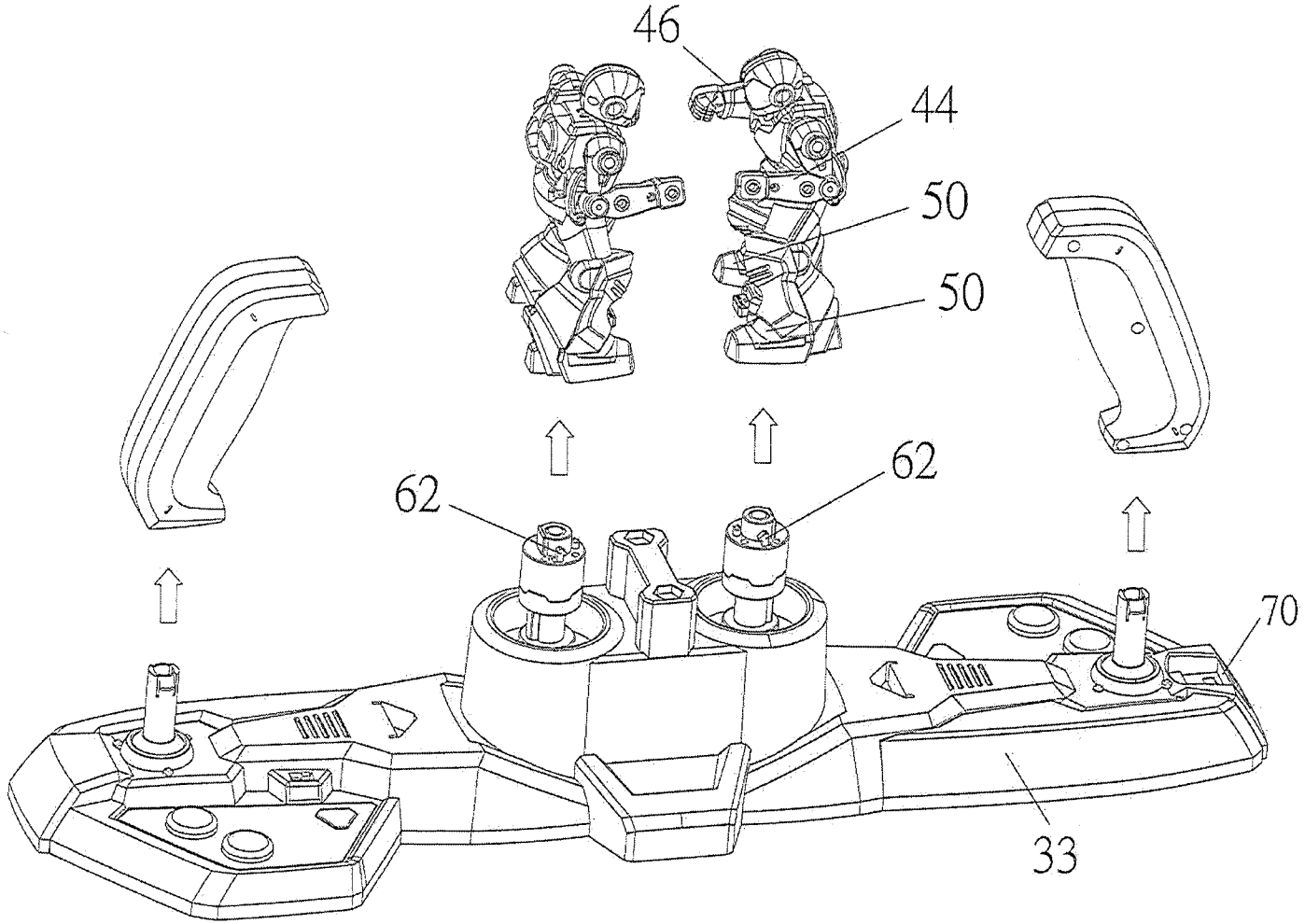

FIG. 10C is a representation of one of the robots, and associated handle and control base for the mounting the robot in a position with the robot separated from the control base and indicated to be removed from the shaft passing outwards from the control base.

Figure 11:
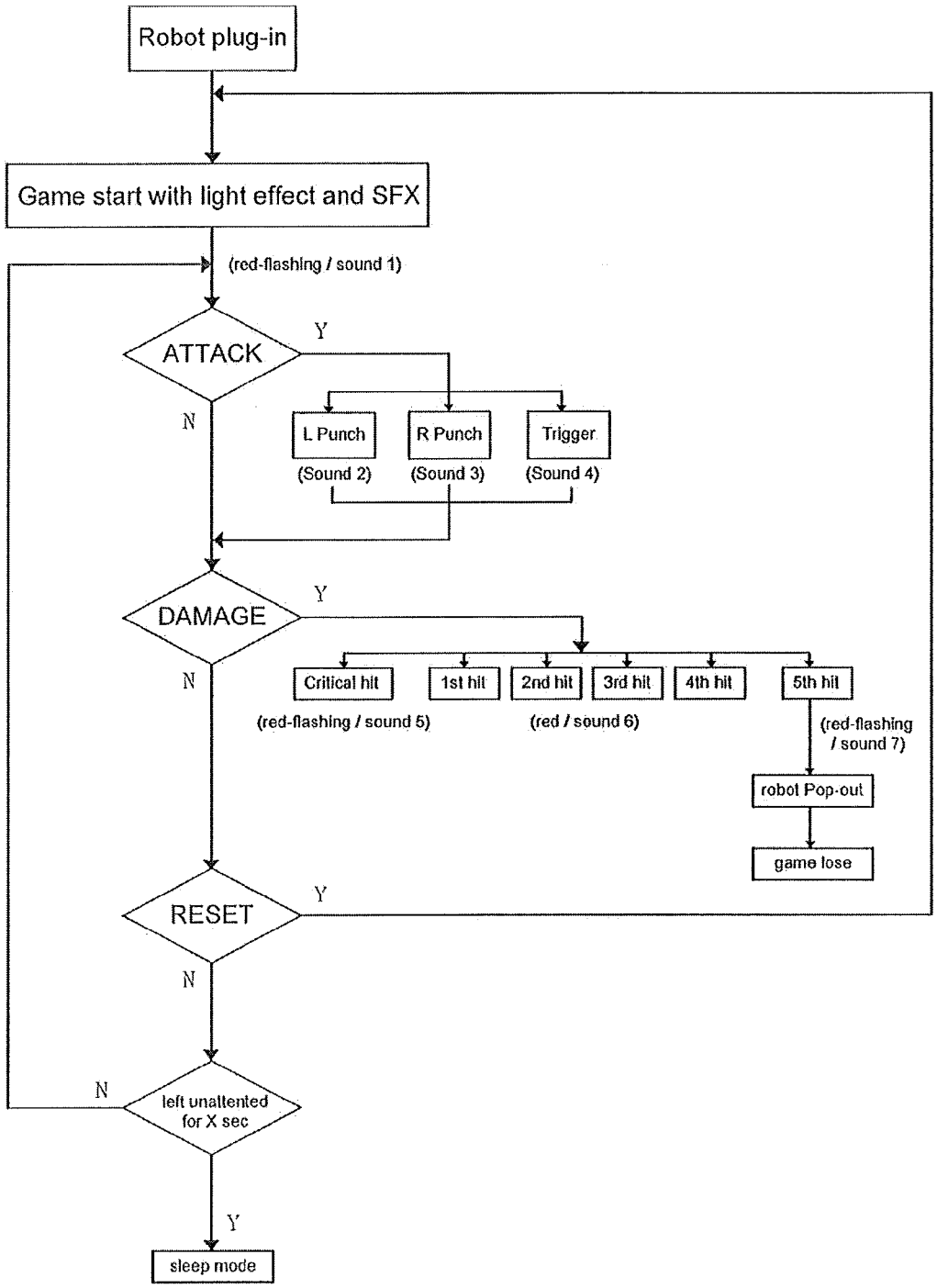

FIG. 11 is a flow chart for showing one basic form of the game sequence.

Figure 12:
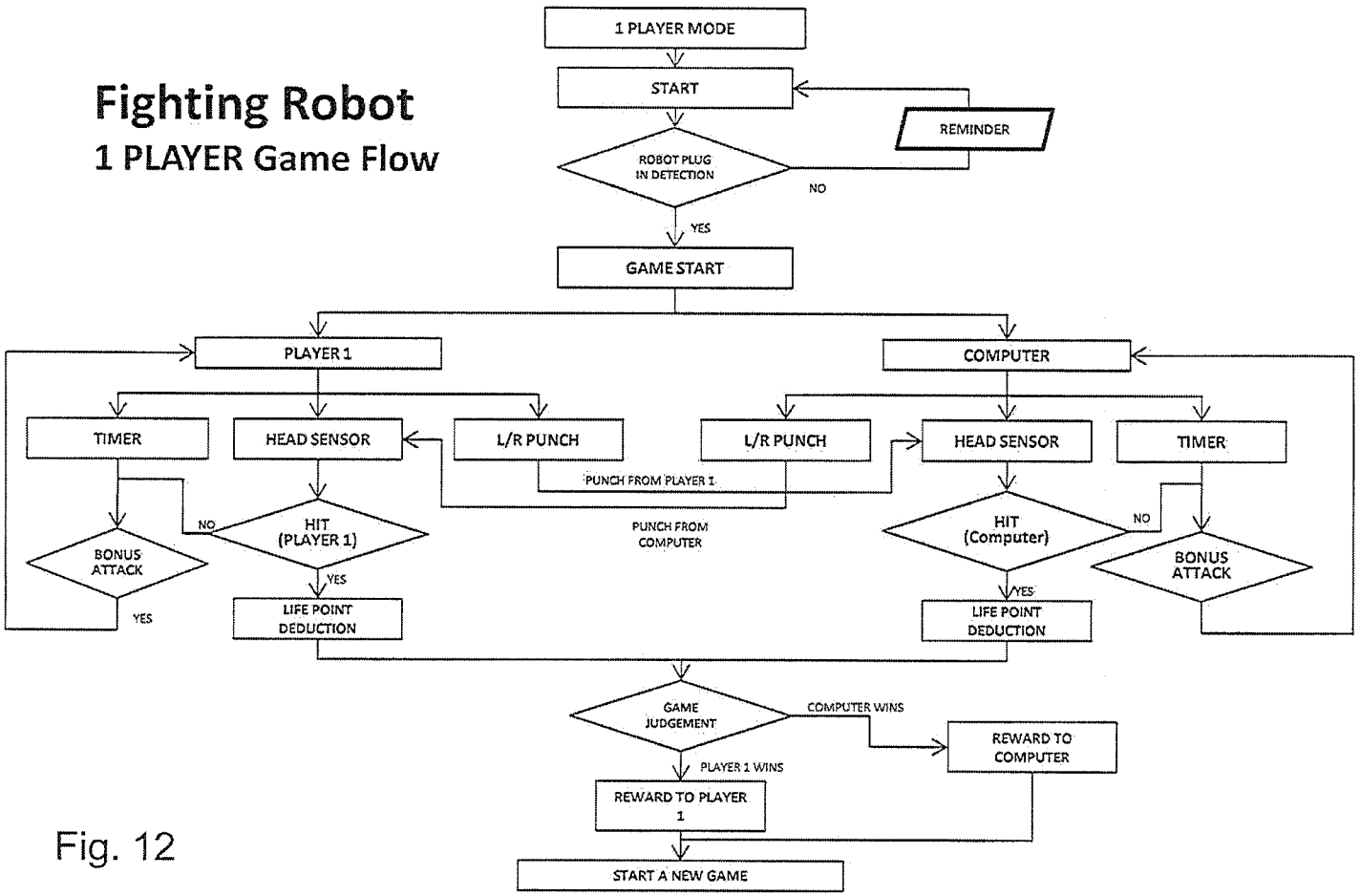

FIG. 12 is a flow chart for showing another form of the game sequence.

Figure 13:
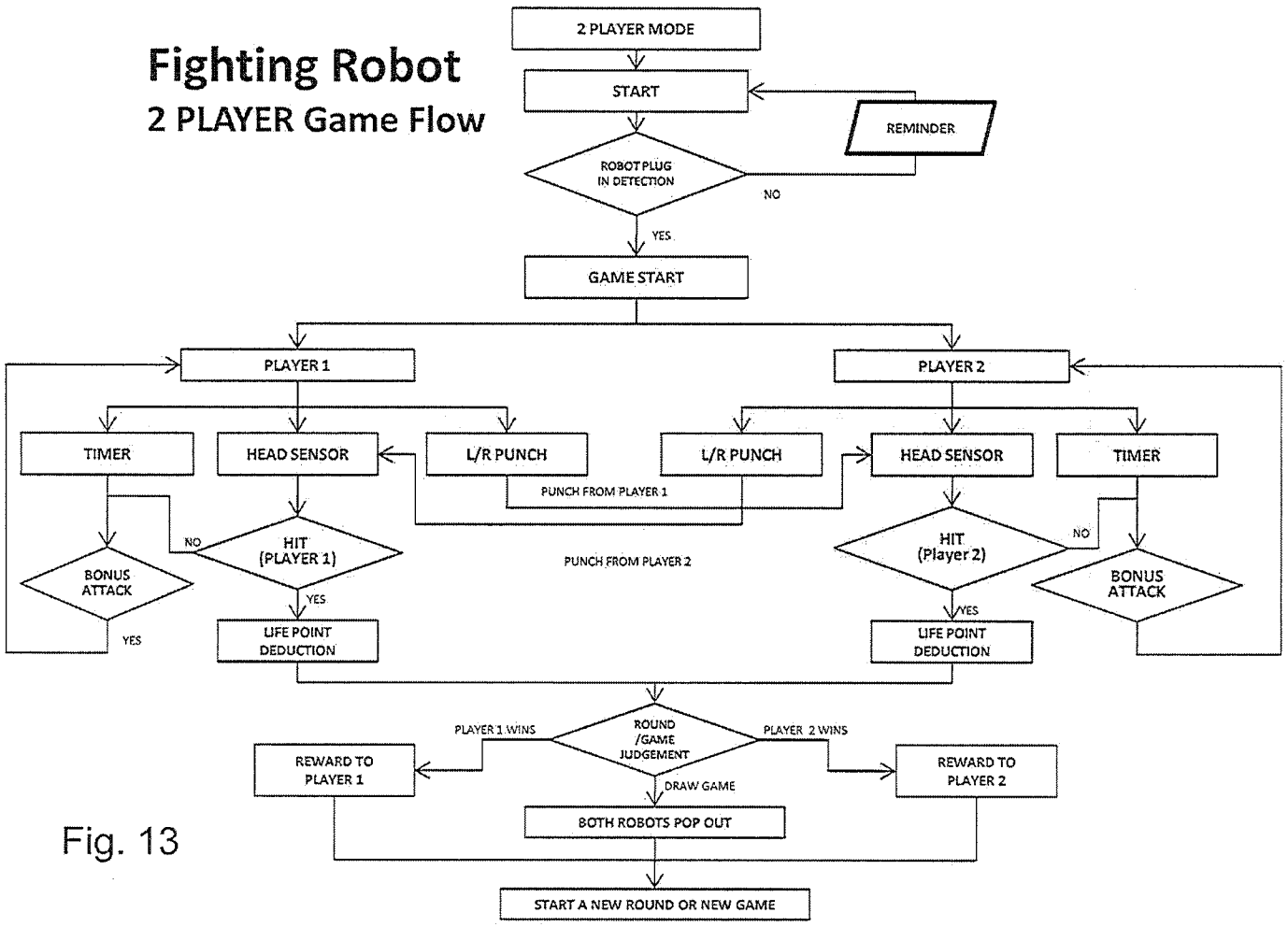

FIG. 13 is a flow chart for showing another advanced form of the game sequence.

Figure 14:
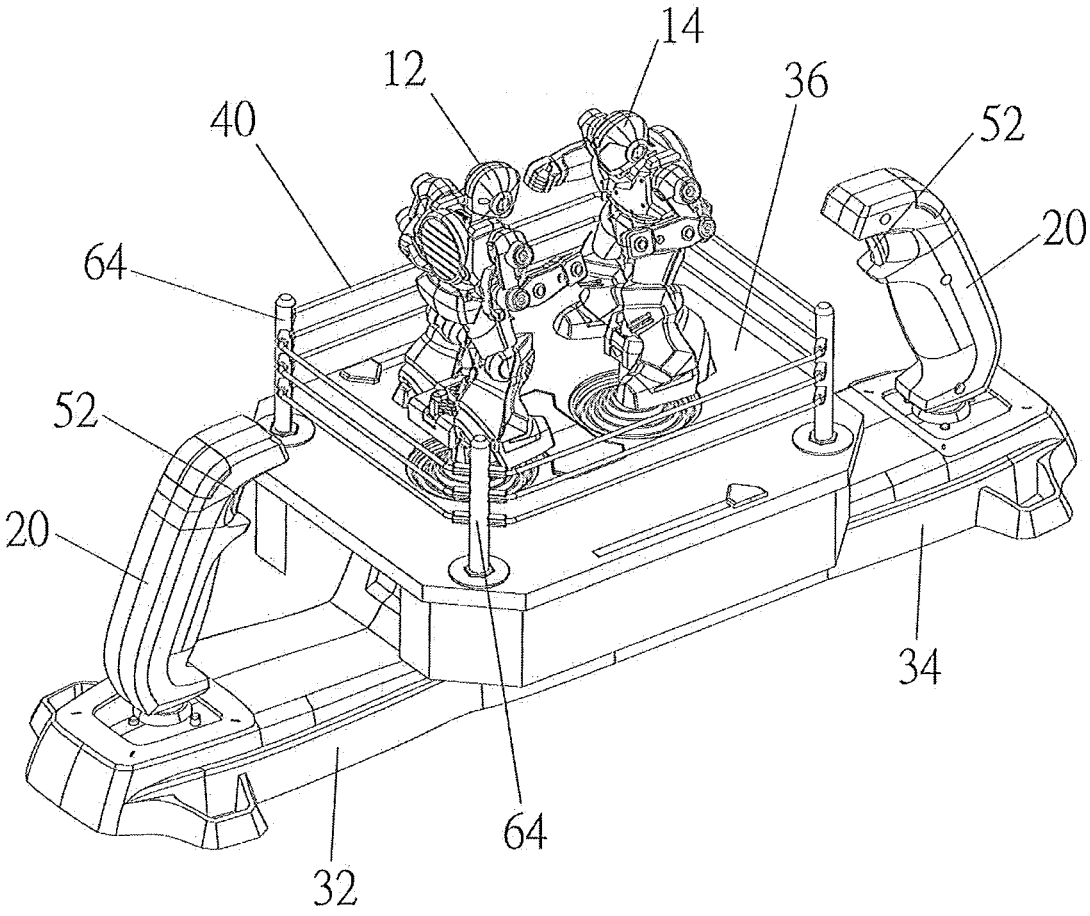

FIG. 14 is another representation of the game showing the robots, with the joy stick handles, the fighting stage and the control base.

Figure 15:
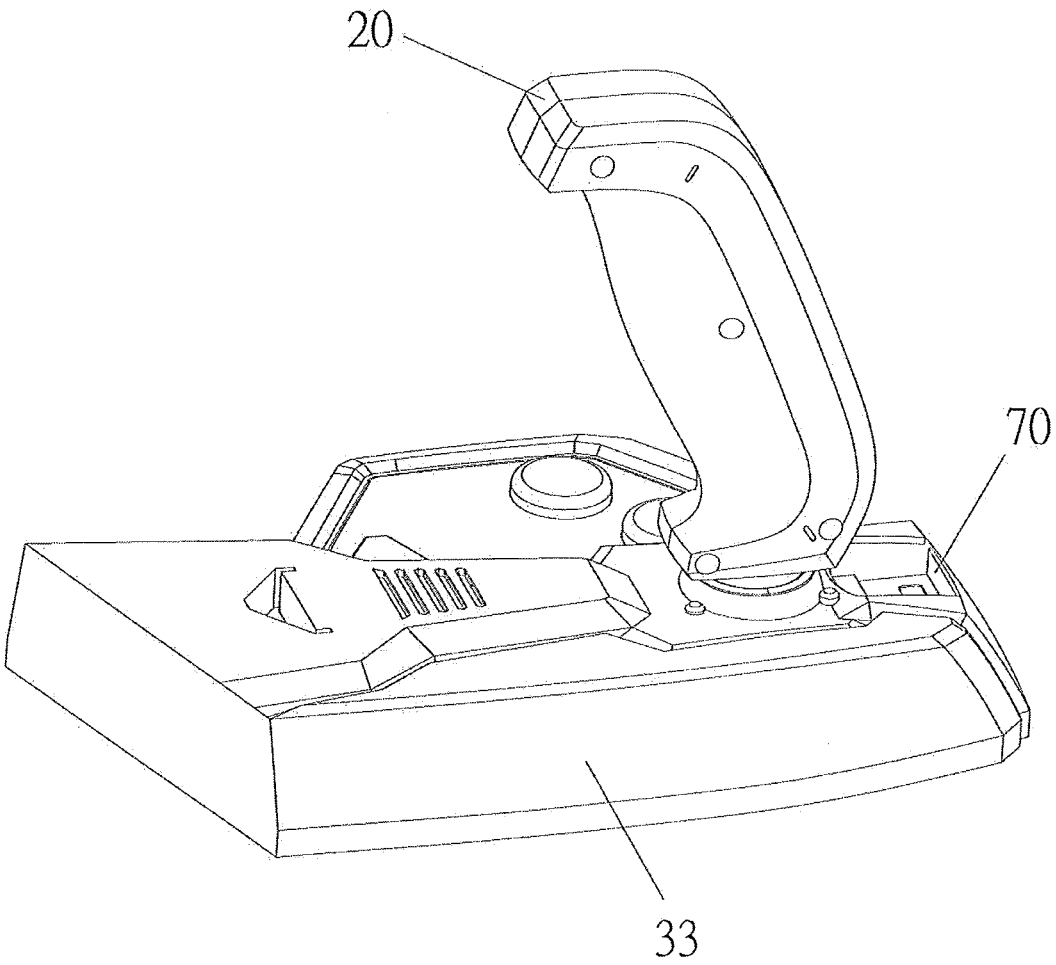

FIG. 15 is another representation of the game showing the detail of the mode switch.

Figure 16:
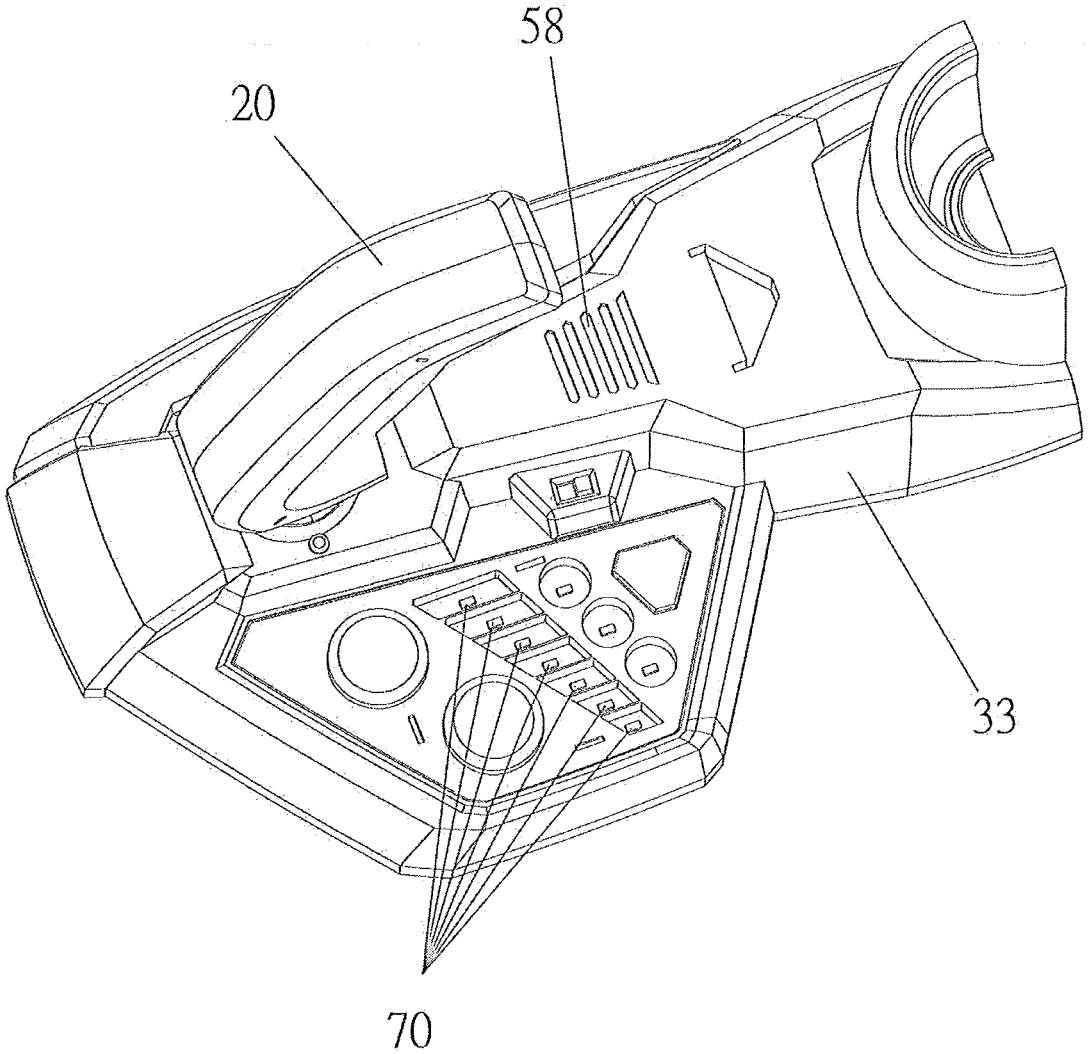

FIG. 16 is another representation of the game showing the detail of the scoring display.

Figure 17:
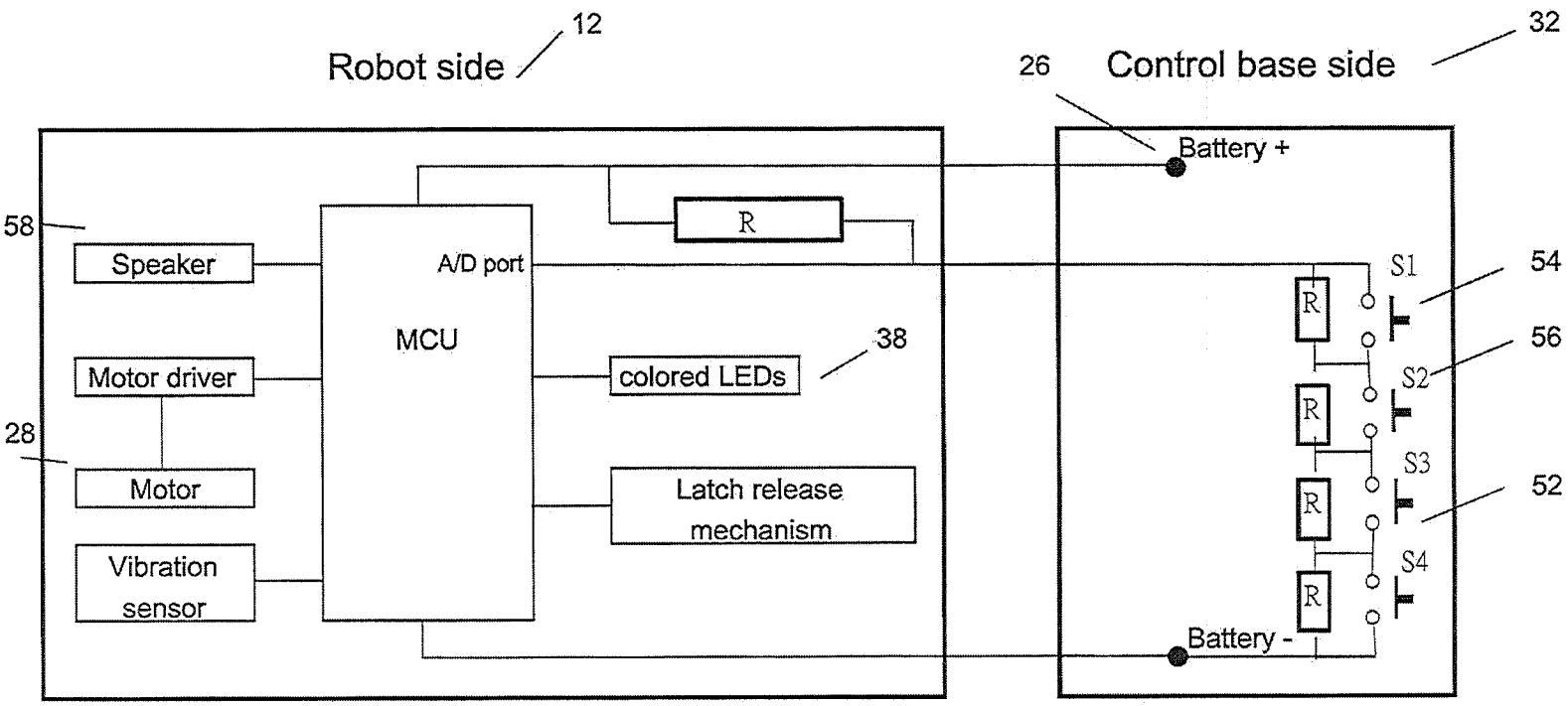

FIG. 17 is a block diagram of the electronic components of one form

Figure 18:
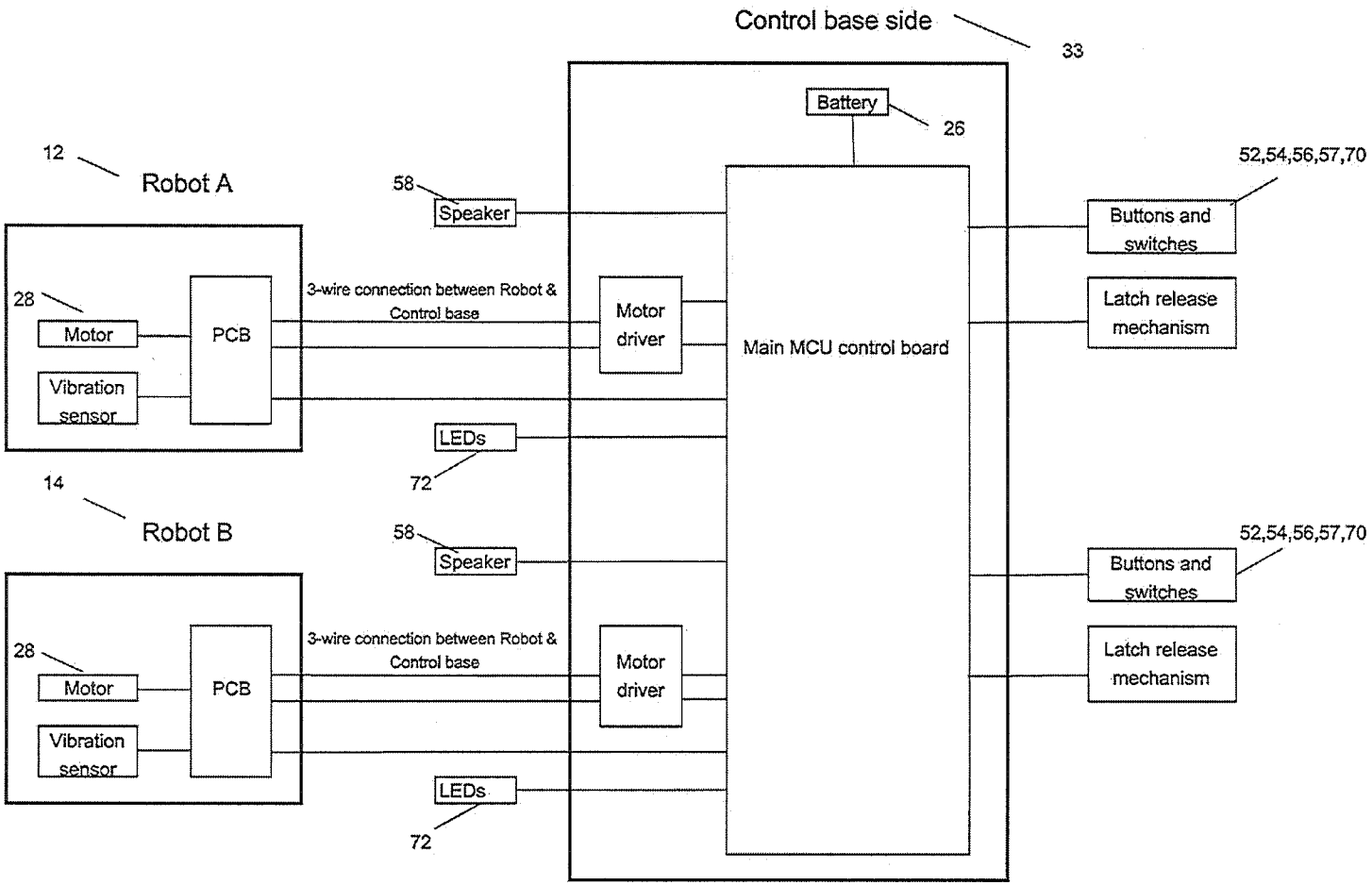

FIG. 18 is a block diagram of the electronic components of another form.

DETAILED DESCRIPTION

The disclosure is exemplified as a one-to one robots fighting game. The toy includes accessory characters being two robots, and one or two control bases, two armor sets and a fighting stage.

In the one form, there can be one control base. In this form there are 2 robots fighting each other, and either there is a two players mode or one player mode (namely play with a computer).

Speakers and LEDs instead of being located inside each robot can be positioned in the control base.

Batteries can be located in the control base while the mini motor and the gear drive system are in the robot.

List of Numerical References Used in the Drawings.

Figure 1:
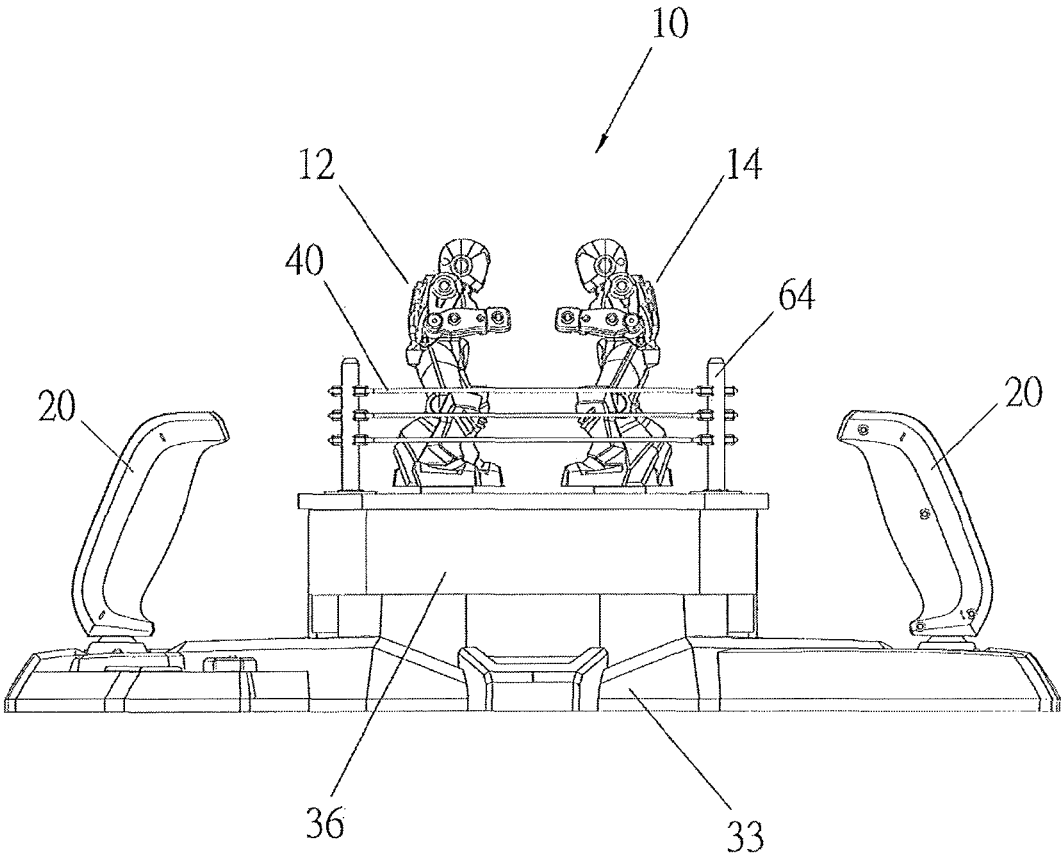
FIG. 1 is a first representation of the game showing the robots, with the joy stick handles, the fighting stage and the control base.
Figure 2:
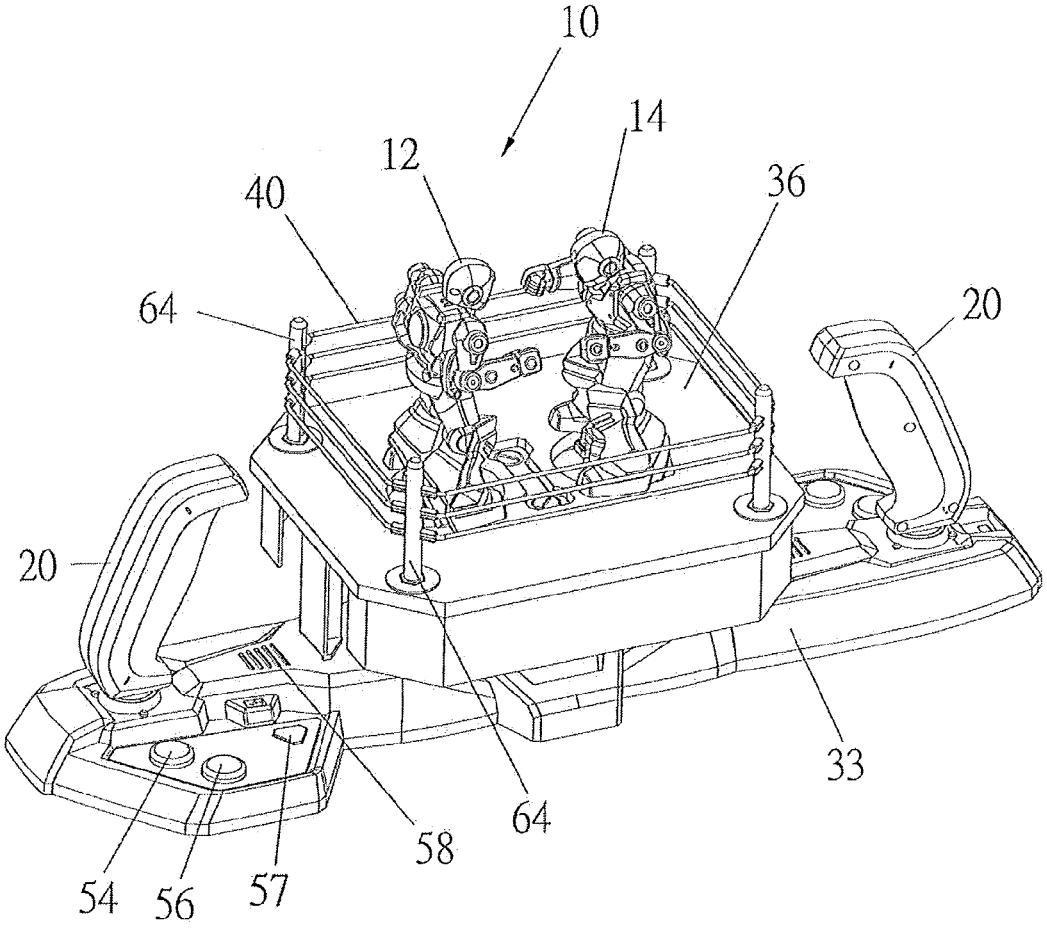
FIG. 2 is another representation of the game showing the robots, with the joy stick handles, the fighting stage and the control base.
Figure 3A:
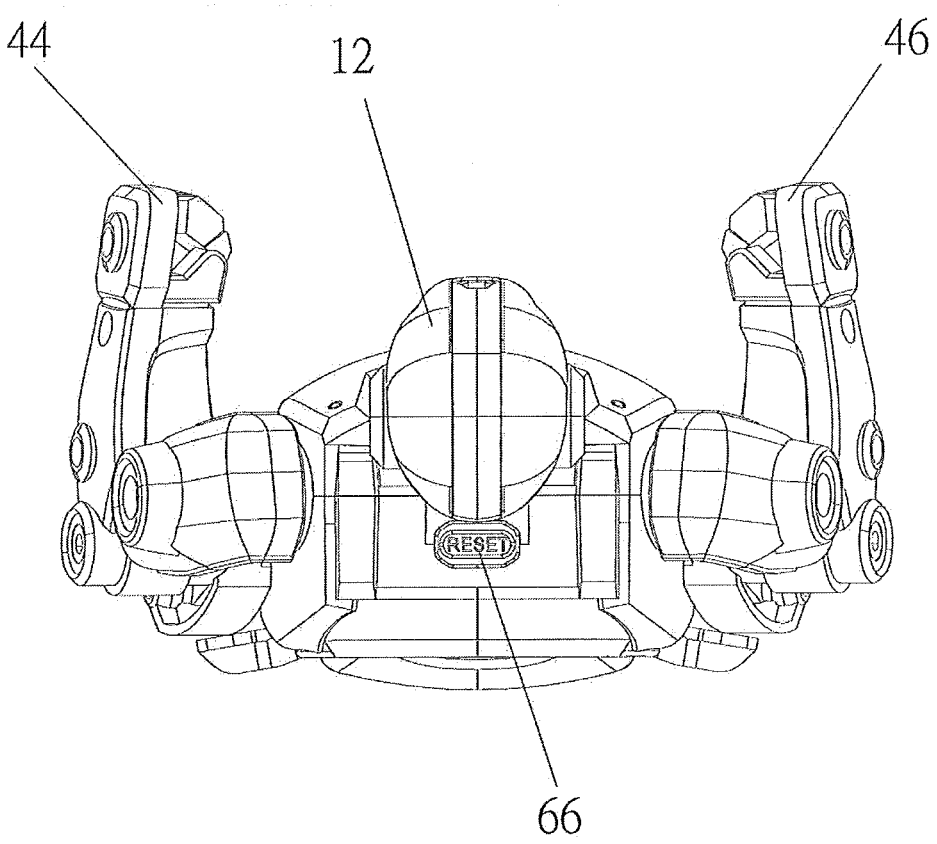
FIG. 3A is a detailed top view representation of one of the robots in a first position.
Figure 3B:
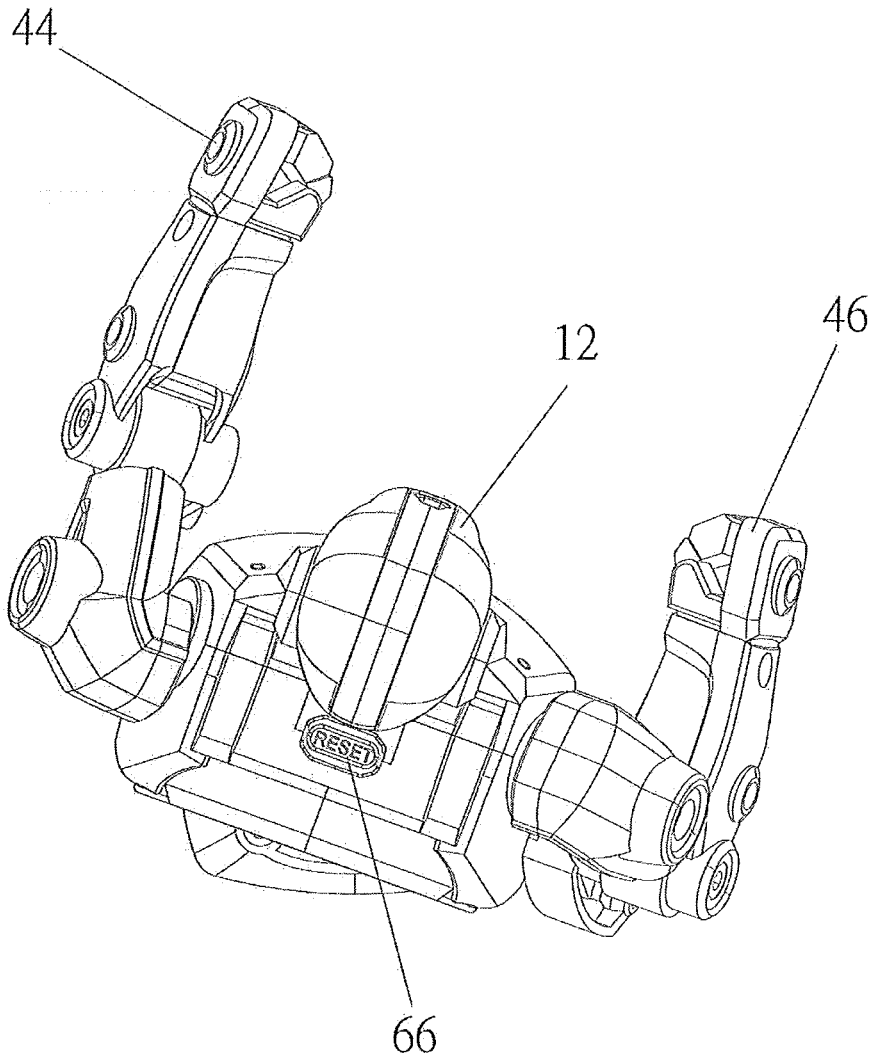
FIG. 3B is another detailed top view representation of one of the robots in a second position.
Figure 3C:
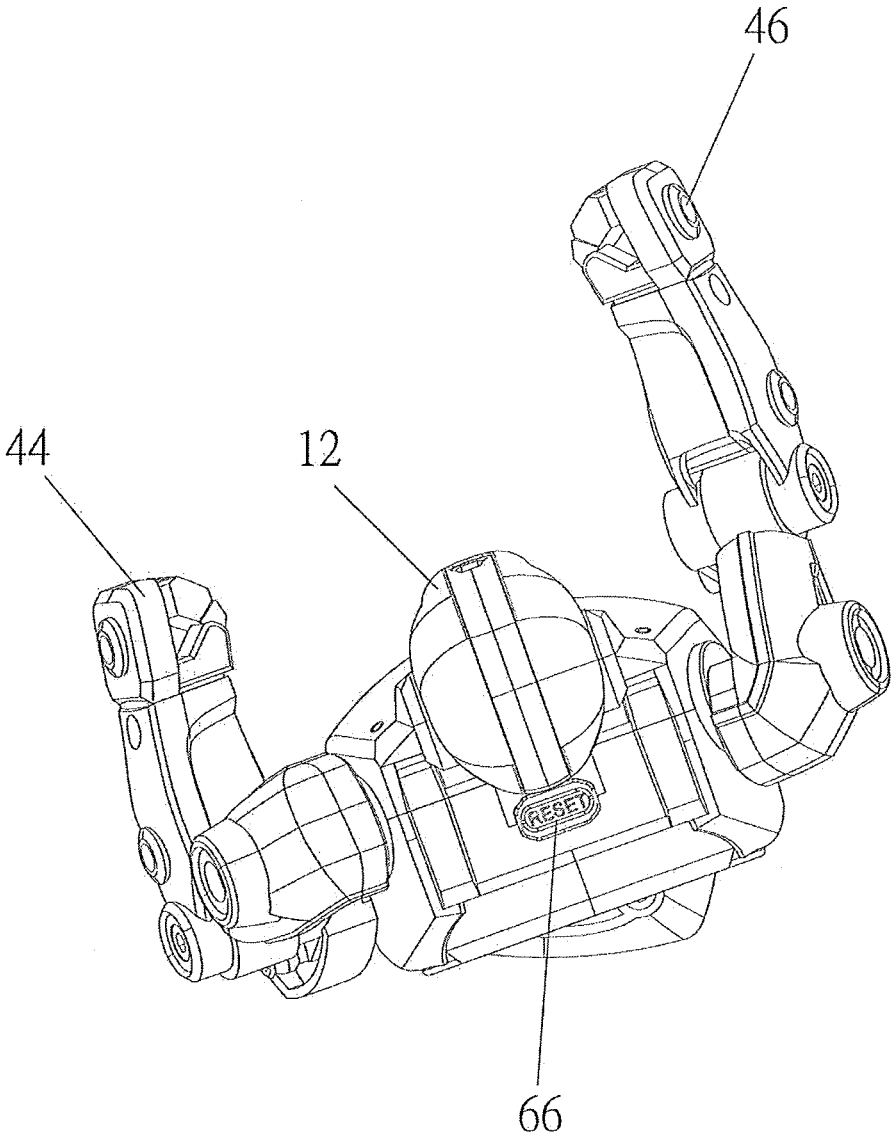
FIG. 3C is another detailed top view representation of one of the robots in a third position.

| Component | Reference Number |
|---|---|
| toy | 10 |
| two robots | 12, 14 |
| lever | 16 |
| shaft | 18 |
| handle | 20 |
| physical mechanical connection with the handle | 22 |
| swing or turn movement | 24 |
| supply of electricity | 26 |
| motor and gear | 28, 30 |
| one control base (in a first embodiment of FIG. 1) | 33 |
| two control bases (in a second embodiment of FIGS. 7A and 14) | 32, 34 |
| fighting stage | 36 |
| colored LEDs | 38 |
| stage ring | 40 |
| spring | 42 |
| left and right arms | 44, 46 |
| waist | 48 |
| Legs | 50 |
| trigger | 52 |
| left and right trigger | 54, 56 |
| start button | 57 |
| Speaker | 58 |
| Accessories | 60 |
| manually lock and unlock hook | 62 |
| lock and unlock button | 63 |
| spaced posts | 64 |
| reset key | 66 |
| Mode (player) selector | 70 |
| LED | 72 |

Different changes on the game flow are described in the specification and flow chart.

As such the game, product and method is a fighting robot table top system. It is a One to One boxing game, and includes a base, two fighting robots and a boxing stage. Players use the handles to control the robots for multi-directional movements and robots' fist movements are motor driven that controlled by action buttons.

There are two battling modes: 1 PLAYER mode is a Player vs. Computer time challenge game. 2 PLAYER mode is a 5 rounds game that player wins 3 rounds will be the game winner.

Each robot's base has spring coil built underneath that will pop the Robot out of the stage once he is beat in a round or a game. Each player has life point and round point displayed on their control panel and it also generate different light and sound effects during the battle.

On start up, the Slide POWER switch to "ON" position (SFX1+LFX1). The unit will go to sleep mode after no input for 2 minutes, press the START button to wake up the unit.

Mode Selection

For "1 PLAYER" mode, push the mode switch forward lock the handle shaft until the wording "1 PLAYER" is fully visible.

2 For "2 PLAYER" mode, pull the mode switch out until the wording "2 PLAYER" is fully visible.

3 When entered to "1 PLAYER" mode, (SFX2+LFX2)

4 When entered to "2 PLAYER" mode, (SFX3+LFX3)

5 When the power is ON and the mode is selected, the unit will go to sleep mode after no input in 2 minutes, press the START button to wake up the unit.

6 If the mode is changed during the game play, the game will be reset to the new selected mode.

Game Start

1 Install the handles to the slots on both side of the base.

2 Each player to plug their robot onto the base and press "START" button on their side for game start. (SFX4)

3 In 1 PLAYER mode, the player has to make sure the handle and robot in "Computer" side is installed.

4 Once Start buttons are pressed, the computer will detect if the Robots are plugged correctly or not, it will generate a warning (SFX5+LFX4) on the side that robot is not properly plugged.

5 If the Robots are properly plugged, the game will start with a welcome sound effect, (SFX6+LFX5)

6 After game has started, the system will generate a reminder sound effect (SFX7+LFX6) to remind players starting battle if there is no input after 5 seconds, keep generate reminder every 5 seconds.

7 The unit will go to sleep mode after no response of 3 minutes, press the START button on any side to wake up the unit. (SFX4). It will play welcome sound effect (SFX6+LFX5) after the unit is wake up.

8 If the robot is taken out from the base during the play, the player will be judge as lose the Game/Round and grant the "WIN" to the opponent.

6 General Game Rules

1 To attack, press "L" Button to release Left Punch and "R" button to release Right Punch. There will be different sound effects of every punch released (Player 1—L punch/SFX8, Right Punch/SFX9; Player 2—L punch/SFX10, Right Punch/SFX11).

2 Life points will be displayed in light bar with 7 LED (1 LED=3 life points).

3 Round Score Display—Display the Major Life point in 1 PLAYER mode, displays round point in 2 PLAYER mode.

4 When robot's head is hit by a light punch: 1 sensor is triggered (SFX23), ⅓ Life points will be deducted. 1 point will be deducted if he is hit by a heavy punch: 2 sensors are triggered (SFX24), details as following table:

| | Before hit | 1st Light punch | 2nd light punch | 3rd light punch | Heavy Punch |
|---|---|---|---|---|---|
| LED brightness | 100% | Blinking | Faster Blinking | Turn off | Direct turn off |

Remarks: if the Heavy punch is recorded aftera Light Punch, the LED will turn off and also blinking the next LED.

Bonus Punch

1 There are two types of bonus punches that player can obtain during the fight:

I. Combo Punch—after the player has accumulated 6 punch releases within 3 sec, a "Combo" bonus punch will be granted and the "Life Point" LED will flash (SFX12+LFX7). To release the Combo punch (continue L/R/L/R/L punches within 1 sec), press two punch buttons at the same time, it comes with a sound effect when combo punch is released (SFX13+LFX 8).

II. Heavy Punch—after game start and the player has successfully avoided hit for 5 sec, "Heavy" bonus punches will be granted (SFX14+LFX9) and his punches (no matter L or R) in following 3 seconds will automatically be Heavy punches. It comes with a sound effect when Heavy punches are released (SFX15+LFX10).

2 After the Bonus punch is used, the computer will reset the accumulated data and restart counting.

3 Bonus punches are available in both 1 PLAYER and 2 PLAYER modes.

Mode—1 PLAYER

1 This is a 3 minute time challenge game. To win the game, the contender has to achieve hit difference+5 life points or above.

2 Only "Player 1" side can be used to play and "Player 2" side is the "Computer" side.

3 Press "START" to start the game (SFX4), then follows with a welcome sound effect (SFX16+LFX11).

4 In game start, each player has 70 life points—3 Major life points (3 LED×21 life points)+7 Life Points (LED bar).

5 During the fight, contender side player can use handle to control the movement of the Robot figures in different directions—pose it in better positions to attack or avoid the attack. The "Computer" side has computer controlled punch actions only, no body movements.

6 Refer to "General Game Rules" for scoring.

7 The computer will generate a countdown reminder in last 5 seconds. (SFX17).

8 After times up, the loser's Robot will pop out (SFX18) from the base and follow with a sound effect and the "GAME WINNER" will be rewarded with sound effect+Light effect on the control panel. (SFX19+LFX12)

9 If the Robot is taken out from the base during the middle of the play (SFX18), the player will be judge as lose the game and grant a "GAME WIN" to the computer side. (SFX19+LFX12)

10 Press "START" to play 1 PLAYER game again or use MODE switch to select 2 PLAYER game.

Mode—2 PLAYER

1 This is a 5 rounds game—Player wins 3 rounds firstly out of 5 would be the GAME WINNER.

2 Each player has full life points at game start & 7 LEDs will be lighted up on their control panels.

3 During the fight, both players can use handle to control the movement of the Robot figures in different directions—pose it in better positions to attack or avoid the attack.

4 Refer to "General Game Rules" for scoring.

5 Player losing all life points will be judged as the "LOSER" and his Robot will pop-out automatically from the base (SFX18), and follow with sound effects and flashing LEDs on the panel of the "ROUND WINNER" (SFX20+LFX13).

6 If both players have life points deducted to zero at the same moment (a time slot within 0.2 sec), both Robots will pop out from the base at same time (SFX18), it will be judged as a "DRAW GAME" (SFX21+LFX14). No Round points will be changed and the round will restart again.

7 When a player wins his 3rd round, he will directly becomes "GAME WINNER" of and will be rewarded with Game winning sound & light effect (SFX22+LFX15).

8 Press "START" to play 2 PLAYER game again or use MODE switch to select 1 PLAYER game.

9 The unit will go to sleep mode if there is no input after 5 minutes, press the START button to wake up the unit.

Fighting Power Control

1 At the beginning of every new round, the punch speed will start with 60% of full load (PWM), the punch speed gets faster when the life points drops.

2 When the player has lesser life points, his punching speed will be faster as tables of FIGS. 18*a* to 18*e*:

Sound and Light Effects

| Sound Effect | Description | Duration | File name | Light Effect | Description |
|---|---|---|---|---|---|
| SFX1 | Power ON key tone | 0.x Sec | | LFX1 | Power ON light effect |
| SFX2 | Enter to 1 PLAYER mode | 0.x Sec | | LFX2 | Enter to 1 PLAYER mode |
| SFX3 | Enter to 2 PLAYER mode | 0.x Sec | | LFX3 | Enter to 2 PLAYER mode |
| SFX4 | Start button key tone | 0.x Sec | | | |
| SFX5 | No Robot plugged Warning | 0.x Sec | | LFX4 | No Robot plugged Warning |
| SFX6 | Welcome (2 PLAYER Mode) | 0.x Sec | | LFX5 | Welcome (2 PLAYER Mode) |
| SFX7 | Reminder if no input | 0.x Sec | | LFX6 | Reminder if no input |
| SFX8 | Left Punch (Player 1 | 0.x Sec | | | |
| SFX9 | Right Punch (Player 1) | 0.x Sec | | | |
| SFX10 | Left Punch (Player 2) | 0.x Sec | | | |
| SFX11 | Right Punch (Player 2) | 0.x Sec | | | |
| SFX12 | Combo Punch Ready | 0.x Sec | | LFX7 | Combo Punch Ready |
| SFX13 | Combo Punch Released | 0.x Sec | | LFX8 | Combo Punch Released |
| SFX14 | Heavy Punch Ready | 0.x Sec | | LFX9 | Heavy Punch ready |
| SFX15 | Heavy Punch Released | 0.x Sec | | LFX10 | Heavy Punch Released |
| SFX16 | Welcome (1 PLAYER GAME) | 0.x Sec | | LFX11 | Welcome (1 PLAYER GAME) |
| SFX17 | Last 5 Sec countdown | 0.x Sec | | | |
| SFX18 | Robot Pop out | 0.x Sec | | | |
| SFX19 | GAME WIN (1 PLAYER mode) | 0.x Sec | | LFX12 | GAME WIN (1 PLAYER mode) |
| SFX20 | ROUND WIN (2 PLAYER mode) | 0.x Sec | | LFX13 | ROUND WIN (2 PLAYER mode) |
| SFX21 | DRAW GAME (2 PLAYER mode) | 0.x Sec | | LFX14 | DRAW GAME (2 PLAYER) |
| SFX22 | GAME WIN (2 PLAYER mode) | 0.x Sec | | LFX15 | GAME WIN (2 PLAYER) |
| SFX23 | Light Punch Recorded | 0.x Sec | | | |
| SFX24 | Heavy Punch Recorded | 0.x Sec | | | |

In other forms of the disclosure there can be different set ups for the game play and features of the disclosed product and method.

Instead of one control base there can be two control bases. In this form there are 2 robots fighting each other, and either there is a two players mode or one player mode (namely play with a computer).

The disclosure includes the law of the lever applied where there is a shaft connecting the robot and the handle which controls swing and turn movement of the robot.

The disclosure also includes the supply of electricity located at the base and supplied through the shaft from the bottom to the robot for making attack motions.

Some product description characteristics are set out.

In one form a toy comprises two robots. There is a lever system with a shaft connecting at least one robot to a handle. The robot is responsive to movement of the handle through a physical mechanical connection with the handle whereby movement of the handle moves the robot. The movement of the handle by a player controls at least one of swing or turn movement of the robot.

A supply of electricity to the robot is provided so that a motor with each robot permits making robot motions in response to movement from the motor. The motor movement is responsive to a signal from the player. The robots are for interaction with each other. An effective engagement between the robots is at least one of recorded or indicated.

In another form there are two control bases, and a fighting stage. There is a lever system with a shaft connecting each respective robot to the handle; and the supply of electricity located at the base from the bottom of the robot.

In yet another form each of the two robots includes a lever system with a shaft connecting each respective robot to a respective handle. Each respective robot is responsive to movement of the respective handle through a physical mechanical connection with the handle. Movement of the handle moves the respective robot, and movement of the handle by a player controls at least one of swing or turn movement of the robot; a supply of electricity to each robot. Each robot includes a motor for making robot motions in response to movement from the motor. The motor movement is responsive to a signal from the player of each respective robot. The robots are for interaction with each other. An effective engagement between the robots is at least one of recorded or indicated.

An electric path to the motor is supplied through a shaft passing in the robot.

The operation characteristics of the robot including control of motion of the robot being Forward, Backward, Left and Right, and spinning 45 degree Left and Right. The control of motion is directed through a shaft, and the shaft is located through a fighting stage.

The control of motion of the robot includes the mechanical connection, the mechanical connection including an operation through a lever system between the handle and a shaft passing into the robot. Additionally through the motor movement, the control of the motion is for driving a multi-directional fighting action for the robot.

The handle operation is synchronized with shaft movement by physical connection with levers while buttons and triggers on the handle controls the motor electrically and hence arm movement of the robot.

There can be one or more colored LEDs inside the robot, the LEDs being for indicating the effective engagement between robots.

There is the fighting stage for the robots and a base for locating the robots relative to the stage. The robot position on the stage is being relatively fixed about a shaft extending above the fighting stage such that movement in a horizontal sense is fixed by the extending shaft. There is a stage ring accessory for surrounding the fighting stage.

The control base is below the robot and is for mounting the robot. There is a spring and there is a shaft extending in the robot. The spring is mounted with the shaft and is for forcing the robot relatively downwards at a predetermined stage of a fight. The predetermined stage is representative of a loss of a fight by the robot. The spring and shaft are in a locking engagement with the control base.

There is a motor for each robot, and each robot has left and right arms for a punching action and a waist about which a twisting action of the robot is affected. Each motor is for driving a twist of the waist of the robot for a left or right punch action of a respective arm.

A trigger can operate the robot. A play sequence program for the robot movement can be a combination of a left punch and a trigger action or a right punch and a trigger action to represent the performance of an extra power punch attack. The non activation of the trigger for operating the robot is a play sequence program wherein the robot movement is a left punch or a right punch to represent the performance of a single left or right punch respectively.

There can be a left or right punch trigger for the handle, the trigger being respectively for a left punch and a right punch respectively combination attack. The combination attack is selectively a programmed auto rapid punching within a predetermined time. The time can be selectively charged for a single time use after a predetermined number of operations of either left or right punch trigger. The handle is for controlling the action of the robot, the control being for at least one of a right punch, a left punch, and a combination attack.

The toy can include a speaker. The speaker can be being responsive for different kinds of situation through a game flow, such situations selectively being at least one of hit, lose, damage or a combination punching action.

Each robot can have different styles of accessories. A player can selectively install and interchange the accessories manually on the robot for providing extra protection and increasing the relative fighting power and distance between respective robots.

There are legs for robot, a manually lock and unlock located between the legs of the robot for engaging the shaft and for permitting interchanging styles of robot to be attached to the shaft.

The handle includes three buttons for controlling the action of the robot, one button being a right punch button, another button being a left punch button, and a third button being a combination attack trigger. In another form, those buttons can be located next to the handle.

The handle is adapted to perform in a joystick control way and selectively includes a spinning action, selectively about 45 degrees for clockwise and anti-clockwise respectively relatively to a forward position, the forward position being representative of moving the robot positions relatively directly toward each other.

The fighting stage can be a paper-craft stage, and there are spaced posts and a ring material between the posts. The stage is installed over a control base, and the control base is for connecting with each robot functionally and to the electric power and to a lever system connected to the handle.

The control base includes a shaft connecting the respective robot and the handle for controlling swing and turn movement when the robot is plugged into the stage.

The game play program includes setting up a one-to-one battle game between the robots, connecting each of two robots to a respective control base, locating the fighting stage over the respective control base for each robot, and plugging the two robots onto each respective control base for the power supply to operate the respective robots.

The game program is such that when a power supply is turned on for each of a control base for each robot, the handle controls a swing and twist action to thereby control body movement of the robot. Operating at least one of a left or right button or trigger acts to attack by a punching left or right action and selectively a combination attack of left and right action.

There is an LED inside each robot for lighting up to indicate a representative damage status for each robot. There can be a switch sensor for solid light activation when a head of the robot is representatively hit and a flashing pattern of the LED to indicate representatively a different damage status.

The sensor sensitive in each robot can be for different levels of representative damage to the respective robot. A first level is being equal to damage of one hit, and a second level, selectively being greater punch power or critical impact on the robot thereby to indicate representation of extra damage equal to damage of two hits.

There is a plug under each robot, and a head for each robot. The plug is for unlocking the robot when the head of the robot is subjected to a predetermined number of hits, this number being representative of a fight loss.

When the robot is ejected from the control base, the robot is a loser of a fight. The electrical supply from a control base to the robot is disconnected. When the player re-plugs the robot unit into the control base there is a manual restart of the game. Selectively a damage status indicator returns to zero after each plug-in process or pressing reset key.

Some of the operation characteristics of the robots are Forward, Backward, Left and Right Plus spinning 45 degree Left and Right Control through Stage Shaft. Other features of the toy and game are a mechanical and motor driven multi-directional fighting action. With each robot there is one or more colored LED lighting effect inside each figure's head. The ring accessory can include surrounding the fighting stage while the robots are fighting.

Some main features of each robot are set out.

Electricity is supplied by the stage through the shaft at bottom, which includes a spring coil for urging the robot down to represent a lost position, namely a down position. There is also a lock and unlock feature of the robot on the shaft with and into the control base.

There is one mini motor and gear drive system for each robot which drives the twist of the waist for the left and right punch action.

A combination of a Left punch+trigger/right punch+a trigger performs as an extra power punch attack rather than single pressing in right/left punch.

A trigger button for combination attacks, for instance programmed auto rapid punching—R>L>R>L>R punch within 1 sec, could be charged for single time use after every 20 presses of either left or right punch button.

There can be a built in 29 mm speaker for different kind of situation through the game flow, such as hit/lose/damaged/combination attack.

There can be multiple styles of helmet and knuckles. The user could install and interchange manually on every robot unit. The helmet and knuckles can be for extra protecting and increase the fighting power and distance.

A manually unlock level place between the legs of robot unit for interchanging other style of robot at anytime.

The handle/joystick includes 3 buttons for controlling the action of the robot (right punch button/Left punch button/combination attack trigger) once the power on and robot plugged in.

The handle can perform in a joystick-like-control way plus spinning action, for instance 45 degrees for clockwise and anti-clockwise.

The fighting stage consists of a paper-craft stage, 4 plastic posts and 3 wire ring or rubber band. This could be installed over the control base before the robot plugged into it. Assembling can be effected manually by the user. There can be a rounds counter for round counting which adjusted by player manually.

The control base includes an inner shaft connecting the robot and handle for controlling swing and turn movement when the robot plugged into the stage The main power supplied by plurality no of AA batteries. There are posts for fitting and connection with the fighting stage.

One form of the game play is set out. To setting up one-to-one battle game, firstly connect the 2 pieces of control base, then put the fighting stage over the 2 control base, and finally plug the 2 fighting robot units onto each of control base to get power supply.

An example of the game start is set out. After the power supply is on for each control base, the handle is controlled by swinging and twisting action to control the body movement. Pressing the left/right button and trigger develops an attack by punching action and combination attack.

The red-color LED which inside each robot's head will light up to show the current damage status. The switch sensor will activated every time when the head was get hit and hence changing the flashing pattern of LED color to show different damage status.

The sensor is sensitive for 2 levels of damage, a first level would judge as normal damage which equal to damage of one hit, while a second level, namely needing more punch power or critical impact to trigger would judge as extra damage which equal to damage of two hits.

The plug under each robot unit will unlock once the head gets every 5 hits, namely representing a loss.

The robot can eject out of the control base representing as loser. The power supply from control base disconnected. The user has to re-plug the robot unit into the control manually to restart game. The damage status will return to zero after each plug-in process or pressing reset key.

Some of the product features include product styling which is robotic and athletic style. There can be battle armor, a metal beast which can be mechanical and or a tiger style. Alternatively there can be a frame dragon with fire and dragon style.

The present disclosures provide a toy or game and methods for their manufacture. The figures generally illustrate embodiments of a toy or game and methods for their play in accordance with the present disclosures.

In some other embodiment some other exemplary embodiments of the toy or game there are the different features of handle, fighting stage, control base, joystick action of the handle, trigger, button and the like In one variation for instance, instead of being for two human players for each handle, one of the players could be a computerized program. In such a form the one robot is controlled by a preprogrammed computerized action.

The particular exemplary embodiments of the toy or game illustrated in the figures have been chosen for ease of explanation and understanding of the various aspects of the present disclosures. These illustrated embodiments are not meant to limit the scope of coverage but instead to assist in understanding the context of the language used in this specification and the appended claims. Accordingly, variations of toy or game including claimed aspects of the disclosures different from the illustrated embodiments may be encompassed by the appended claims,

The invention claimed is:

1. A motorized boxing toy comprising two robots, each robot including a body, a head, a left leg, a right leg, a right arm on a right side of the body and a left arm on a left side of the body, the body having a waist and being capable of being twisted around the waist, and a normal mounted position of the robot being with both the legs in a front facing position, and the right arm and the left arm being arranged substantially aligned with each other on the respective left and right sides of the body, a lever system with a shaft connecting at least one robot to a handle, the robot being responsive to movement of the handle through a physical mechanical connection with the handle whereby movement of the handle moves the robot, and wherein movement of the handle by a player controls at least one of swing or turn movement of the robot; a supply of electricity to the robot, the robot including a motor for making robot motions in response to movement from the motor, the motor movement being responsive to a signal from the player, and the motor acting in a first mode to turn the body about the waist such that the left arm can be moved relatively forwardly and the right arm moves relatively backwardly while both the legs remain in the normal front facing location, and in a second mode to turn the body about the waist such that the right arm can be moved relatively forwardly and the left arm moves relatively backwardly while both the legs remain in the normal front facing location, and the robots being for interaction with each other whereby an effective engagement between the robots is at least one of recorded or indicated.

2. A motorized boxing toy comprising two robots, each robot including a body, a head, a left leg, a right leg, a right arm on a right side of the body and a left arm on a left side of the body, the body having a waist and being capable of being twisted around the waist, and a normal mounted position of the robot being with both the legs in a front facing position, and the right arm and the left arm being arranged substantially aligned with each other on the respective left and right sides of the body, a lever system with a shaft connecting each respective robot to a respective handle, the robot being responsive to movement of the handle through a physical mechanical connection with the handle whereby movement of the handle moves the robot, and wherein movement of the handle by a player controls at least one of swing or turn movement of the robot; a supply of electricity to the robot, the robot including a motor for making robot motions in response to movement from the motor, the motor movement being responsive to a signal from the player, and the motor acting in a first mode to turn the body about the waist such that the left arm can be moved relatively forwardly and the right arm moves relatively backwardly while both the legs remain in the normal front facing location, and in a second mode to turn the body about the waist such that the right arm can be moved relatively forwardly and the left arm moves relatively backwardly while both the legs remain in the normal front facing location, and the robots being for interaction with each other whereby an effective engagement between the robots is at least one of recorded or indicated, at least one control base, and a fighting stage, the power supply runs from the control base to the bottom of the toy robot.

3. A method of operating a motorized boxing toy comprising two boxing robots, each robot including a body, a head, a left leg, a right leg, a right arm on a right side of the body and a left arm on a left side of the body, the body having a waist and being capable of being twisted around the waist, and a normal mounted position of the robot being with both the legs in a front facing position, and the right arm and the left arm being arranged substantially aligned with each other on the respective left and right sides of the body, the arms being movable forwardly and backwardly relative to the legs, and the forward movement of each robot being representative of a punch being delivered to the other robot, and the punching speed being variable, a lever system with a shaft connecting each respective robot to a respective handle, having each respective robot selectively be responsive to movement of the respective handle through a physical mechanical connection with the handle, moving at least one handle to effect movement of the respective robot, and wherein movement of the handle by a player controls at least one of swing or turn movement of the robot; supplying electricity to each robot, each robot including a motor for making robot motions in response to movement from the motor, the motor movement being responsive to a signal from the player of a robot, the robots being for interaction with each other whereby an effective engagement between the robots is at least one of recorded or indicated, at least one control base, and a fighting stage, causing at least one of the robots to respond to a player and the other of the robots to respond to a player or a computer control action for moving the robot of operating a motorized toy, and including configuring a game between the robots wherein each robot has designated life points at a game start, and during game play when a player has lesser life points, the punching speed of the robot increases.

4. The toy of claim 1 comprising an electric path to the motor being supplied through the shaft passing in the robot.

5. The toy of claim 1 comprising operation characteristics of the robot including control of motion of the robot being Forward, Backward, Left and Right, and spinning 45 degree Left and Right.

6. The toy of claim 5 wherein the control of motion is directed through the shaft, the shaft being located through a fighting stage.

7. The toy of claim 1 wherein a control of motion of the robot includes the mechanical connection, the mechanical connection including an operation through the lever system between the handle and the shaft passing into the robot, and the control of motion and additionally including the motor movement, the motor movement being for effecting the twisting action about the waist, the motor being mounted such that a drive shaft from the motor is directed in a direction from towards a top to towards a bottom of the robot, and a gear transversely connected with the drive shaft whereby motion of the drive shaft is transferred to movement in a transverse plane and the movement of the gear acting to engage a position of the waist to effect the twisting action in a transverse direction, and the control of the motion being for driving a multi-directional fighting action for the robot.

8. The toy of claim 1 comprising at least one or more colored LEDs inside the robot, the LEDs being for indicating the effective engagement between robots.

9. The toy of claim 1 comprising a fighting stage for the robots and a base for locating the robots relative to the stage, the robot position on the stage being relatively fixed about the shaft extending above the fighting stage such that movement in a horizontal sense is fixed by the extending shaft, and a stage ring accessory for surrounding the fighting stage.

10. The toy of claim 1 comprising a control base below the robot and for mounting the robot, a spring, and the shaft extending in the robot body, the spring being mounted with the shaft and being for forcing the robot relatively downwards at a predetermined stage of a fight, the predetermined stage being representative of a loss of a fight by the robot, the spring and shaft being in a locking engagement with the control base, the spring acting to pop the robot out of and free from an operative locking engagement with the control base on a loss of fight.

11. The toy of claim 1 comprises a motor for each robot, each robot having the left and right arms for a punching action and the waist about which the twisting action of the robot is effected, each motor being for driving the twist of the waist of the robot for a left or right punch action of a respective arm.

12. The toy of claim 1 comprising a trigger operating the robot, and a play sequence program wherein for the robot movement being a combination of a left punch and a trigger action or a right punch and a trigger action is representative of the performance of an extra power punch attack, and the non activation of the trigger for operating the robot is a play sequence program wherein the robot movement being a left punch or a right punch is representative of the performance of a single left or right punch respectively.

13. The toy of claim 1 comprising a left or right punch trigger for the handle, the trigger being respectively for a left punch and a right punch or a combination attack, the combination attack selectively being a programmed auto rapid punching within a predetermined time, the time being selectively charged for a single time use after a predetermined number of operations of either the left or right punch trigger.

14. The toy of claim 11 comprising a speaker, the speaker being responsive to different kinds of situation through a game flow, such situation selectively being at least one of hit, lose, damage or a combination punching action.

15. The toy of claim 1 comprising for each robot, different styles of accessories, wherein a player selectively installs and interchanges the accessories manually on the robot for providing extra protection and increasing the relative fighting power and distance between respective robots.

16. The toy of claim 1 comprising a manually lock and unlock located between the legs of the robot for engaging the shaft, the shaft being directed between the legs, for permitting interchanging styles of robot to be attached to the shaft.

17. The toy of claim 1 wherein the handle is adapted to perform in a joystick control way and selectively includes a spinning action, selectively about 45 degrees for clockwise and anti-clockwise respectively relative to a forward position, the forward position being representative of moving the robot positions relatively directly toward each other.

18. The toy of claim 1 including a control base which includes the shaft connecting the respective robot and the handle for controlling swing and turn movement when the robot is plugged into a stage.

19. The toy of claim 1 comprising a game play program including setting up a one-to-one battle game between the robots, connecting each of the two robots to a control base, locating a fighting stage over the respective control base for each robot, and plugging the two robots onto the control base for the power supply to operate the respective robots.

20. The toy of claim 19 comprising a game program wherein the power supply is turned on for the control base for each robot, the handle controls the swing or twist movement of the robot and operating at least one of a left or right button or trigger to attack by a punching left or right action and selectively a combination attack of left and right action.

21. The toy of claim 1 comprising an LED inside each robot for lighting up to indicate a representative damage status for each robot, and including a switch sensor for solid light activation when a head of the robot is representatively hit and a flashing pattern of the LED to indicate representatively a different damage status.

22. The toy of claim 1 comprising a vibration sensor sensitive in each robot for different levels of representative damage to the respective robot, a first level being equal to damage of one hit, a second level, selectively being greater punch power or critical impact on the robot thereby to indicate representation of extra damage equal to damage of two hits.

23. The toy of claim 1 comprises a plug under each robot, the plug being for unlocking the robot when the head of the robot is subjected to a predetermined number of hits, this number being representative of a fight loss, and unplugging acting to move the robot out of and free from an operative locking engagement with a control base.

24. The toy of claim 1 including a control base, and wherein the robot is ejected from a control base when the robot is a loser of a fight, the supply of electricity from a control base to the robot is disconnected, and wherein the player re-plugs the robot unit into the control base manually to restart a game, and selectively a damage status indicator returns to zero after each plug-in process or by pressing a reset key.

25. The motorized toy as claimed in claim 23 including cutting off the supply of electricity to the robot when the robot is popped out of the locking engagement.

26. The method of operating a motorized toy as claimed in claim 3 including having the motor acting in a first mode to turn the body about the waist such that the left arm can be moved relatively forwardly and the right arm moves relatively backwardly while both the legs remain in the normal front facing location, and in a second mode to turn the body about the waist such that the right arm can be moved relatively forwardly and the left arm moves relatively backwardly while both the legs remain in the normal front facing location.

27. The method of operating a motorized toy as claimed in claim 3 including having the control base below the robot and for mounting the robot, a spring, and the shaft extending in the robot body, the spring being mounted with the shaft and being for forcing the robot relatively downwards at a predetermined stage of a fight, the predetermined stage being representative of a loss of a fight by the robot, the spring and shaft being in a locking engagement with the control base, the spring acting to pop the robot out of and free from an operative locking engagement with the control base on a loss of fight.

28. A method of operating a motorized boxing toy comprising two robots, each robot including a body, a head, a left leg, a right leg, a right arm on a right side of the body and a left arm on a left side of the body, a lever system with a shaft to connect at least one robot to a handle, having the robot be responsive to movement of the handle through a physical mechanical connection with the handle whereby movement of the handle moves the robot, moving the handle by a player controls at least one of swing or turn movement of the robot; supplying electricity to the robot, the robot including a motor for making robot motions in response to movement from the motor, having the motor movement respond to a signal from the player, having the robots interact with each other, recording or indicating an effective engagement between the robots, and having a control base below the robot for mounting the robot, a spring, and the shaft extending in the robot body, mounting the spring with the shaft and manually locking and unlocking the shaft to the robot, the shaft being located and directed between the legs of the robot, the shaft being in a locking engagement with the control base, the spring forcing the robot relatively downwards at a predetermined stage of the fight, the predetermined stage being representative of a loss of a fight by the robot, and popping the robot out of and free from an operative locking engagement with the control base on a loss of fight under the spring action.

29. The method of operating a motorized toy as claimed in claim 28 including cutting off the electricity to the robot when the robot is popped out of the locking engagement.

* * * * *